US011466962B2

(12) United States Patent
Beck

(10) Patent No.: US 11,466,962 B2
(45) Date of Patent: Oct. 11, 2022

(54) BALLISTIC COLLAR

(71) Applicant: Tyr Tactical, LLC, Peoria, AZ (US)

(72) Inventor: Jason Beck, Peoria, AZ (US)

(73) Assignee: TYR Tactical, LLC, Peoria, AZ (US)

( * ) Notice: Subject to any disclaimer, the term of this patent is extended or adjusted under 35 U.S.C. 154(b) by 39 days.

(21) Appl. No.: 15/691,333

(22) Filed: Aug. 30, 2017

(65) Prior Publication Data

US 2018/0058818 A1 Mar. 1, 2018

Related U.S. Application Data

(60) Provisional application No. 62/382,079, filed on Aug. 31, 2016.

(51) Int. Cl.
*F41H 1/02* (2006.01)
*A41D 13/05* (2006.01)

(52) U.S. Cl.
CPC ..... *F41H 1/02* (2013.01); *A41D 13/0512* (2013.01)

(58) Field of Classification Search
CPC ..... F41H 1/02; A41D 13/05; A41D 13/0512; A41D 13/0518; A41D 13/0513; A42B 3/0473; A61F 5/055; A63B 71/1291
USPC ..... 2/2.5, 422, 468, 462; 602/18; 128/DIG. 23
See application file for complete search history.

(56) References Cited

U.S. PATENT DOCUMENTS 4,708,129 A * 11/1987 Pujals, Jr. ..... A61F 5/055 128/DIG. 23
5,946,719 A 9/1999 Crupi
6,195,802 B1 * 3/2001 Armellino ..... A41D 13/00 2/102
6,874,170 B1 * 4/2005 Aaron ..... A41D 13/0512 2/468
2005/0166303 A1 * 8/2005 Aaron ..... A41D 13/0512 2/422

(Continued)

FOREIGN PATENT DOCUMENTS

CA 2241747 2/2000
CA 2740968 4/2010

(Continued)

OTHER PUBLICATIONS

Canadian Office Action for Canadian Application No. 2,978,239 dated Jun. 12, 2018.

(Continued)

*Primary Examiner* — Jocelyn Bravo
(74) *Attorney, Agent, or Firm* — KW Law, LLP

(57) ABSTRACT

Implementations described and claimed herein provide systems and methods for protecting a neck of an individual from a threat. In one implementation, a ballistic collar includes a base having a body with a first side portion and a second side portion. A first arm extends along a first longitudinal contour towards the first side portion, and the first arm extends distally along a first contour defined by a first proximal segment and a first distal segment. A second arm extends along a second longitudinal contour towards the second side portion. The second arm extends distally along a second contour defined by a second proximal segment and a second distal segment. Each of the first arm, the second arm, and the base is independently movable relative to each other.

11 Claims, 28 Drawing Sheets

(56) References Cited

U.S. PATENT DOCUMENTS

2007/0010771 A1* 1/2007 Leatt ..... A41D 13/0512 602/18
2008/0177209 A1* 7/2008 Leatt ..... A41D 13/0512 602/18
2010/0056968 A1* 3/2010 Mazzarolo ..... A41D 13/0512 602/18
2010/0121238 A1* 5/2010 Mazzarolo ..... A41D 13/0512 602/18
2010/0142328 A1* 6/2010 Beck ..... F41G 3/147 367/129
2010/0235973 A1* 9/2010 Mazzarolo ..... A41D 13/0512 2/468
2011/0004980 A1* 1/2011 Leatt ..... A42B 3/0473 2/424
2011/0010829 A1* 1/2011 Norman ..... A41D 13/0518 2/459
2011/0041240 A1* 2/2011 Mazzarolo ..... A41D 13/0512 2/468
2011/0225713 A1* 9/2011 Lopez Vicente ... A41D 13/0512 2/468
2011/0288459 A1* 11/2011 Jenkins, III ..... A61F 5/055 602/18
2013/0036538 A1* 2/2013 Sheren ..... A41D 13/0512 2/461
2015/0013039 A1* 1/2015 Parker ..... A41D 13/0512 2/2.5
2018/0266792 A1* 9/2018 Beck ..... F41H 1/02

FOREIGN PATENT DOCUMENTS

| | | | |
|---|---|---|---|
| CA | 2827717 | | 8/2012 |
| CA | 2866334 | | 9/2012 |
| CA | 2836383 | | 6/2015 |
| CA | 3005557 | | 5/2017 |
| ES | 2239873 | A1 | 10/2005 |
| WO | WO 2012/113837 | A1 | 8/2012 |
| WO | WO 2012/113857 | A1 | 8/2012 |

OTHER PUBLICATIONS

Extended European Search Report in related European Application No. 17188807.6 dated Jan. 23, 2018.
First Examiner's Report in related Australian Application No. 2017221832 dated Feb. 22, 2018.

* cited by examiner

BALLISTIC COLLAR

CROSS-REFERENCE TO RELATED APPLICATIONS

The present application claims priority under 35 U.S.C. § 119 to U.S. Provisional Application No. 62/382,079, entitled "Ballistic Collar" and filed on Aug. 31, 2016, which is incorporated by reference in its entirety herein.

TECHNICAL FIELD

The present disclosure relates generally to tactical devices and more particularly to a tactical device providing protection for the neck area of an individual against ballistic threats.

BACKGROUND

Tactical vests, including plate carriers, concealable carriers, low visibility carriers, and the like, are used by military, law enforcement, and other personnel to absorb the impact of and protect against penetration to the body from a threat, such as a ballistic projectile and/or shrapnel from explosions. Such tactical vests include a front portion connected to a rear portion with shoulder straps and provide protection against threats to the torso of a wearer. However, such tactical vests typically provide minimal protection against threats to the neck of the wearer. Tactical accessories may be worn around the neck to compensate for this gap in protection. However, conventional tactical accessories often restrict the movement of the wearer, impair functionality of the tactical vest, and/or suffer from voids between the tactical vest and the accessory creating one or more gaps in threat protection. It is with these observations in mind, among others, that various aspects of the present disclosure were conceived and developed.

SUMMARY

Implementations described and claimed herein address the foregoing problems by providing systems and methods for protecting a neck of an individual from a threat. In one implementation, a ballistic collar includes a base having a body with a first side portion and a second side portion. A first arm extends along a first longitudinal contour towards the first side portion, and the first arm extends distally along a first contour defined by a first proximal segment and a first distal segment. A second arm extends along a second longitudinal contour towards the second side portion. The second arm extends distally along a second contour defined by a second proximal segment and a second distal segment. Each of the first arm, the second arm, and the base is independently movable relative to each other.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Aspects of the present disclosure involve systems and methods for protecting the neck area of an individual from a threat, such as a ballistic projectile, shrapnel from an explosion, impact from a weapon, and/or the like. Generally, a ballistic collar attaches to a back of a ballistic carrier vest with hook and loop straps, an overlapping tongue, and/or other attachments. The shoulder straps on the carrier vest are fed through channels on the ballistic collar without impairing adjustability of the components or a cutaway system of the carrier vest. The ballistic collar includes independent arms allowing for movement of the ballistic collar without gaps in threat protection.

In one aspect, the ballistic collar includes a base and independently positionable arms coupled with the base. The independently positionable arms may include a first arm extending away from a first side of the base and a second arm extending away from a second side of the base. The arms each have a proximal segment disposed at an angle relative to a distal segment. A portion of the proximal segments overlap with each other, and a portion of the distal segments overlap with the base. Each of the proximal segments, distal segments, and the base are movable independent of each other. The overlapping relationship of these portions, as well as the independent movement, permit freedom of movement by the wearer, do not restrict or impair the functionality of the tactical vest or other tactical devices, and prevent gaps in threat protection.

The ballistic collar may further attach to a throat apparatus with one or more throat attachments to protect the throat area of the individual from a threat. The throat attachments may include a sleeve through which a respective throat arm of the throat apparatus are fed and/or hook and loop attachments to engage the throat arms. The tactical protection system can further be implemented with a helmet. The ballistic collar provides coverage between a proximal portion of the tactical vest and a distal portion of the helmet.

Figure 1:
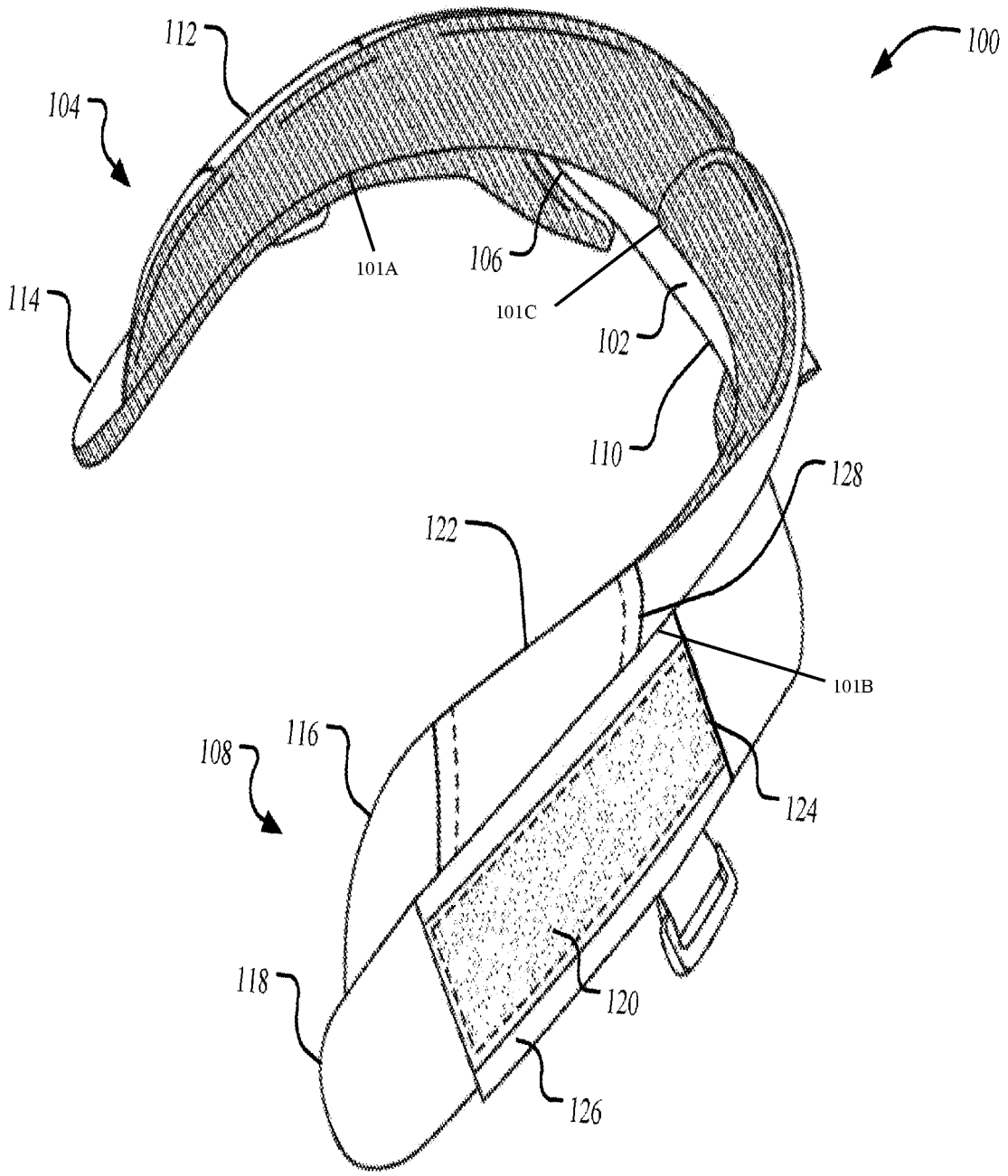
FIG. 1 is a front isometric view of an example ballistic collar.
Figure 2:
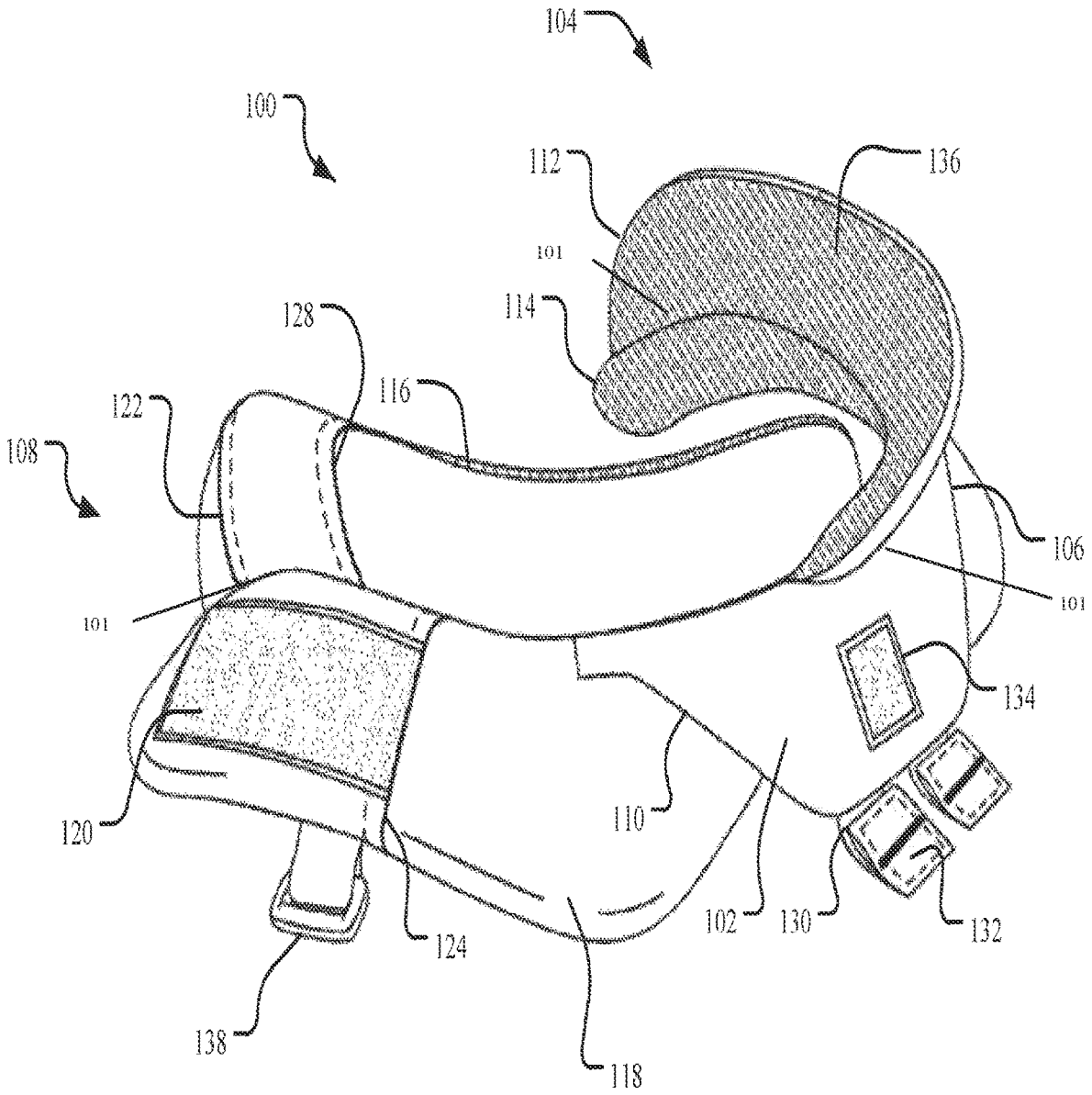
FIG. 2 is a rear isometric view of the ballistic collar of FIG. 1.
Figure 3:
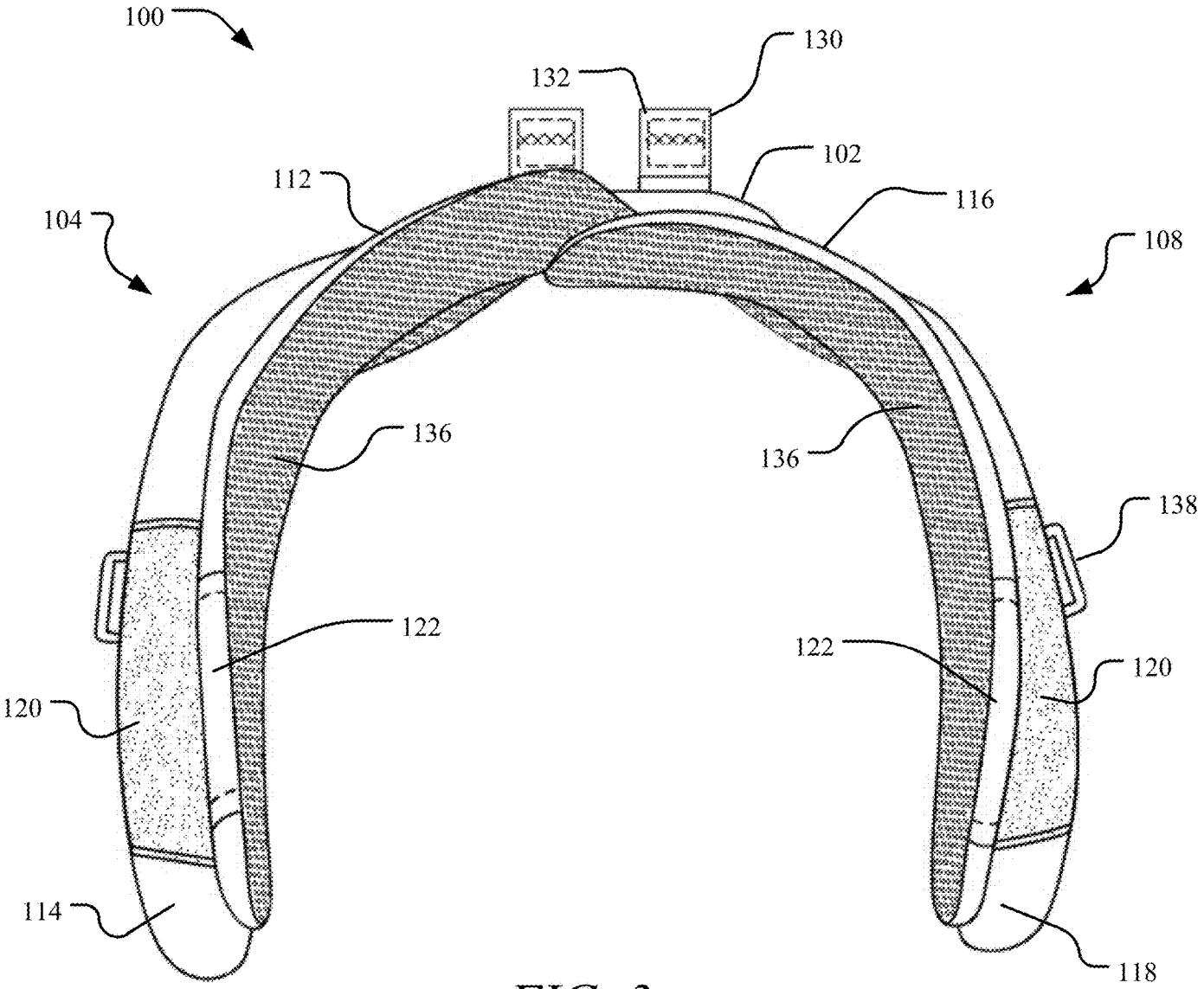
FIG. 3 is a top planar view of the ballistic collar of FIG. 1.
Figure 4:
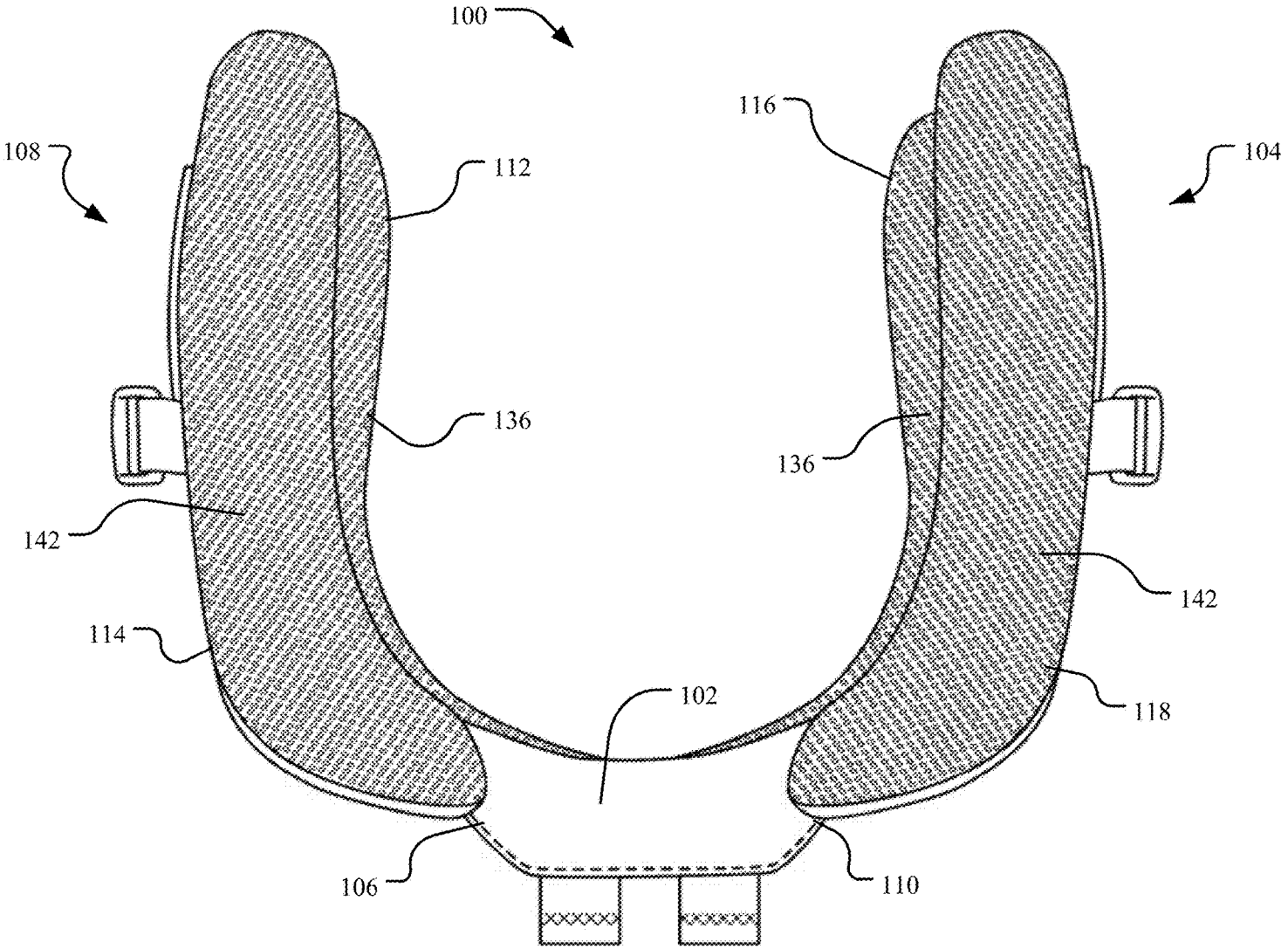
FIG. 4 is a bottom planar view of the ballistic collar of FIG. 1.
Figure 5:
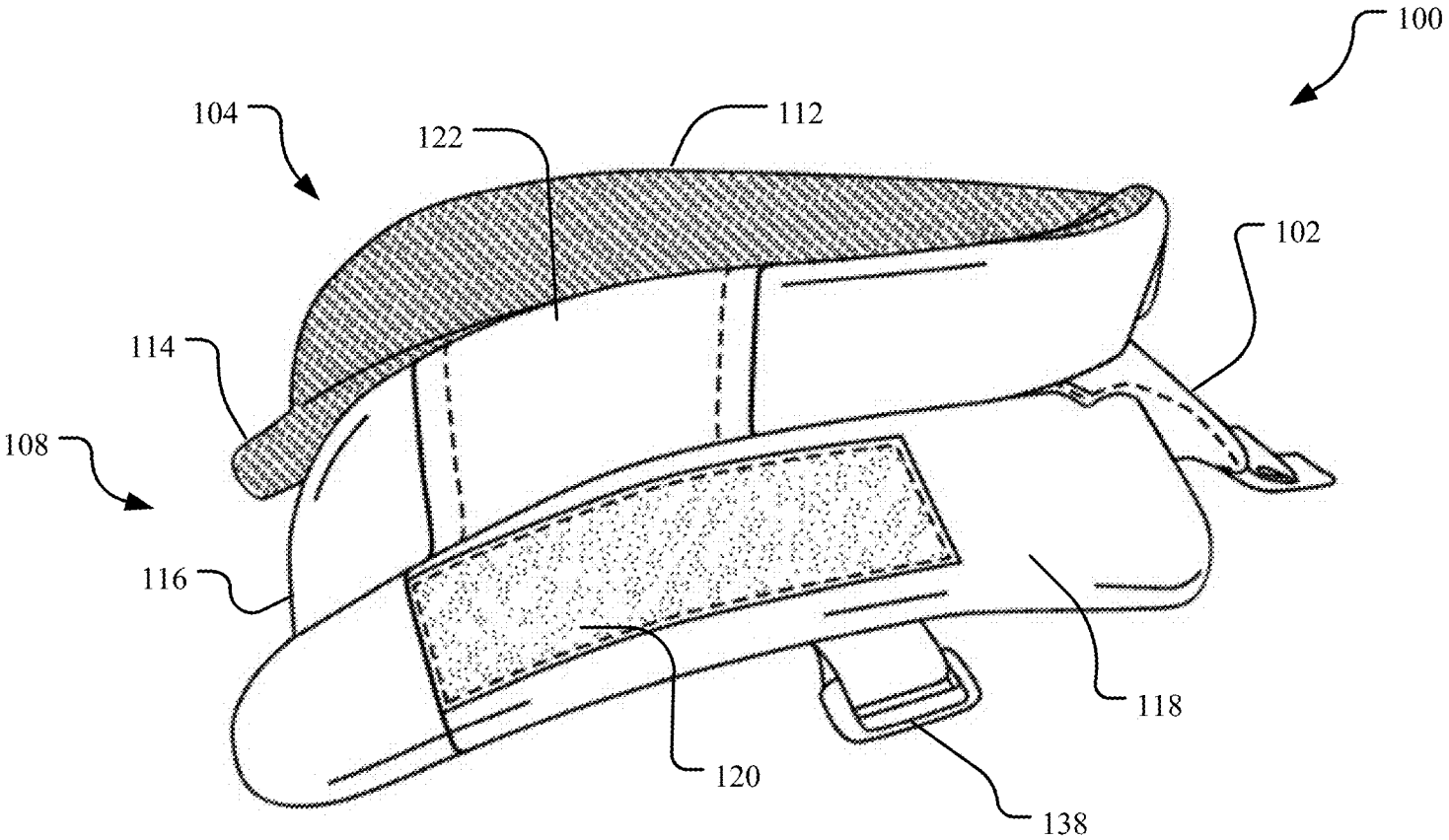
FIG. 5 is a left side view of the ballistic collar of FIG. 1.
Figure 6:
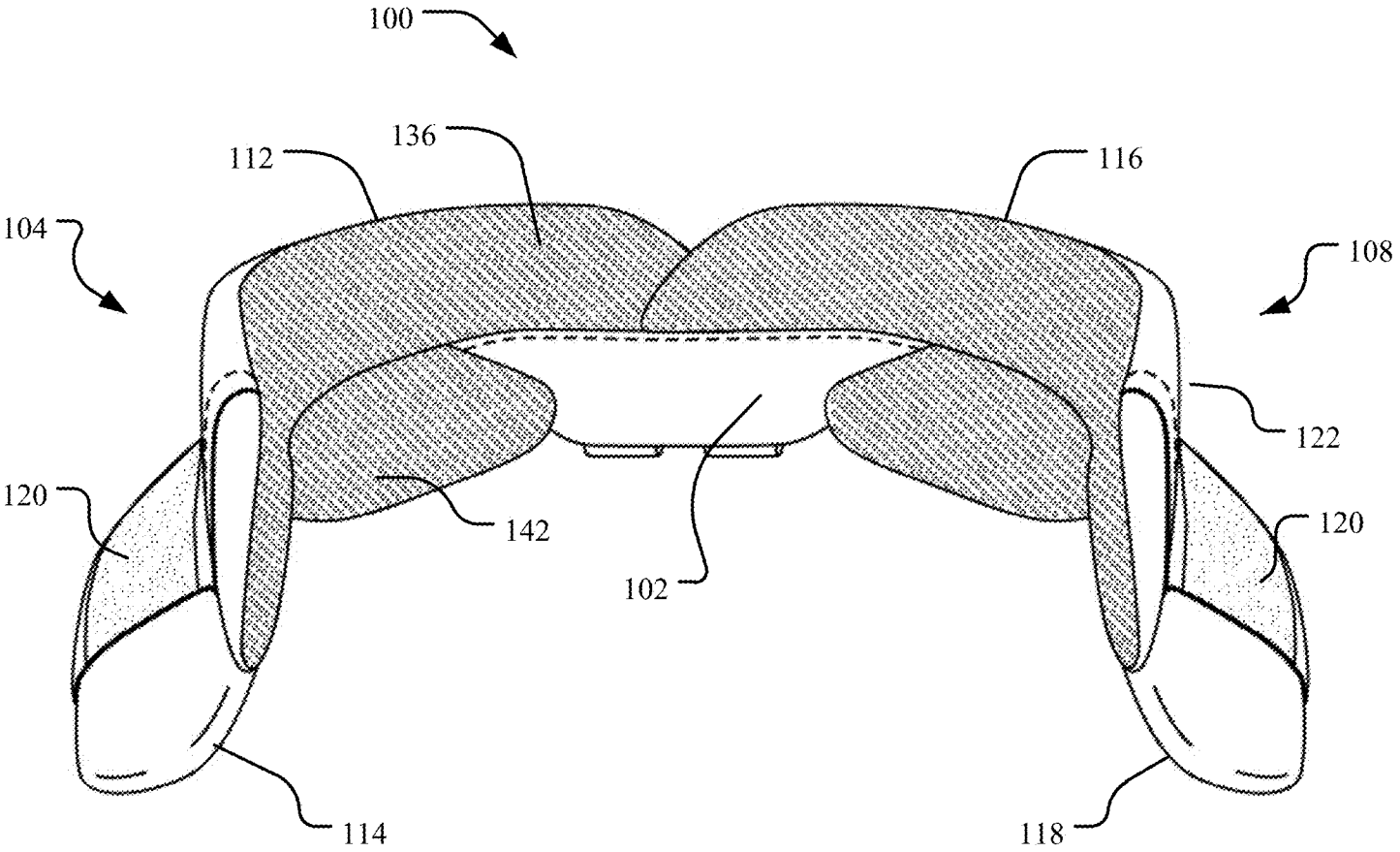
FIG. 6 is a front elevation view of the ballistic collar of FIG. 1.
Figure 7:
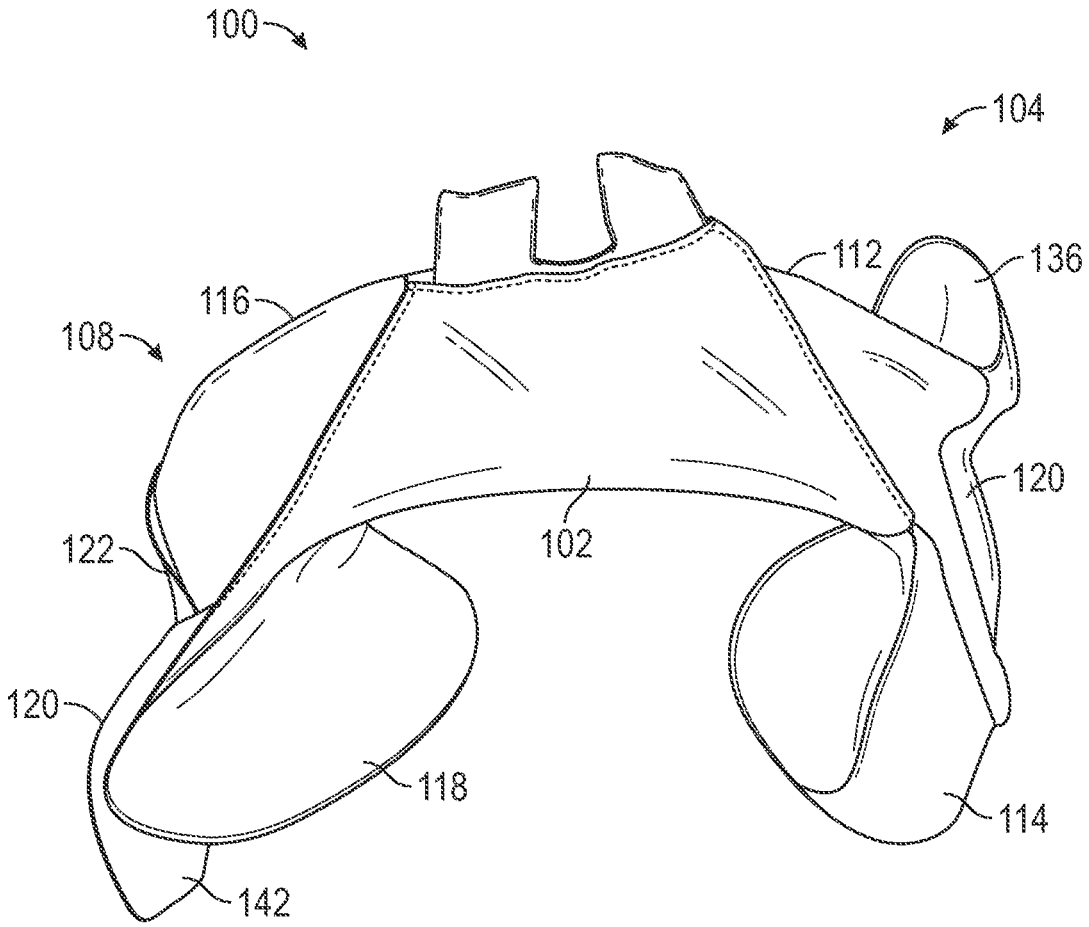
FIG. 7 is a rear elevation view of the ballistic collar of FIG. 1.

For a detailed description of an example ballistic collar 100, reference is made to FIGS. 1-7. In one implementation, the ballistic collar 100 includes a base 102, a first arm 104, and a second arm 108. Each of the first arm 104, the second arm 108, and the base 102 is independently moveable relative to each other, and one to more of the first arm 104, the second arm 108, and the base 102 are layered in an overlapping relationship.

In one implementation, the first arm 104 includes a first proximal segment 112 and a first distal segment 114, and the second arm 108 includes a second proximal segment 116 and a second distal segment 118. Each of the segments 112-118 and the base 102 includes an inner surface, an outer surface, and an interior. The interior may be, for example, a pocket, an interior area defined by the inner surface and the outer surface, and/or the like. The inner surfaces may be oriented towards the wearer and the outer surfaces away from the wearer towards The interior may house one or more ballistic components, which may be removably inserted or permanently integrated into the interior. Such ballistic components may include, without limitation, soft body armor, a ballistic frame, and/or other components configured to adsorb or otherwise protect the neck of the wearer from the impact of a threat. Further, the outer surfaces may include an outermost layer of high performance composite fabric made from a lightweight hybrid material with superior abrasion, tear, and fire resistance characteristics, while providing improved durability, particularly in high-wear areas, such as corners, edges, seams, and exposed areas. Examples of these components and features may be found in U.S. application Ser. No. 15/257,745, entitled "Personal Tactical System" and filed Sep. 6, 2016, which is incorporated by reference herein in its entirety.

In one implementation, the first proximal segment 112 and the second proximal segment 116 each extend longitudinally from a first proximal edge to a second proximal edge and transversely from a third proximal edge to a fourth proximal edge. The first proximal edges of the first proximal segment 112 and the second proximal segment 116 may be disposed at a front of the ballistic collar 100 opposed to each other. A body of each of the first proximal segment 112 and the second proximal segment 116 may extend longitudinally towards the base 102, with a rear portion of each of the bodies curving inwardly towards each other. In one implementation, the second proximal edges of the first proximal segment 112 and the second proximal segment 116 are offset from each other, such that end portions of the rear portions of the first proximal segment 112 and the second proximal segment 116 overlap with each other.

Similarly, the first distal segment 114 and the second distal segment 118 each extend longitudinally from a first distal edge to a second distal edge and transversely from a third distal edge to a fourth distal edge. The first distal edges of the first distal segment 114 and the second distal segment 118 may be disposed at the front of the ballistic collar 100 opposed to each other and relative to the first proximal edges of the first proximal segment 112 and the second proximal segment 116. A body of each of the first distal segment 114 and the second distal segment 118 may extend longitudinally towards the base 102, with a rear portion of each of the bodies curving inwardly towards each other. In one implementation, the second distal edges of the first distal segment 114 and the second distal segment 118 are spaced from each other, forming a gap therebetween.

In one implementation, the first proximal segment 112 is disposed at an angle relative to the first distal segment 114. More particularly, the third proximal edge of the first proximal segment 112 connects to the fourth distal edge of the first distal segment 114, for example, at a seam or via other fixed or removable connections. The body of the first proximal segment 112 extends from the third proximal edge towards the fourth proximal edge in a first direction, and the body of the first distal segment 114 extends from the fourth distal edge towards the third distal edge in a second direction that is different from the first direction. In one implementation, the first direction and the second direction collectively define a contour mirroring a shape of the neck and upper trapezius muscle of the wearer. The first direction may be associated with a vertical component of this contour, and the second direction may be associated with a horizontal component of this contour.

Similarly, the second proximal segment 116 is disposed at an angle relative to the second distal segment 118. More particularly, the third proximal edge of the second proximal segment 116 connects to the fourth distal edge of the second distal segment 118, for example, at a seam or via other fixed or removable connections. The body of the second proximal segment 116 extends from the third proximal edge towards the fourth proximal edge in a first direction, and the body of the second distal segment 118 extends from the fourth distal edge towards the third distal edge in a second direction that is different from the first direction. In one implementation, the first direction and the second direction collectively define a contour mirroring a shape of the neck and upper trapezius muscle of the wearer. The first direction may be associated with a vertical component of this contour, and the second direction may be associated with a horizontal component of this contour. In one implementation, the orientation of the first proximal segment 112 relative to the first distal segment 114 matches the orientation of the second proximal segment 116 relative to the second distal segment 118, with the first arm 104 being opposite the second arm 108.

In one implementation, the base 102 includes a body having a first side portion 106 and a second side portion 110. The first arm 104 may extend generally along a longitudinal contour from the first side portion 106, and the second arm may extend generally along a longitudinal contour from the second side portion 110. The body of the base 102 may extend between a proximal body edge, a distal body edge, a first side edge, and a second side edge. In one implementation, the body tapers distally along the first and second side edges from the proximal body edge to the distal body edge. The proximal body edge of the base 102 may connect to the first arm 104 and the second arm 108 along the connection between the third proximal edge of the proximal segments 112/116 and the fourth distal edges of the distal segments 114/118. The connection of the proximal body edge of the base 102 to the first arm 104 and the second arm 108 positions the body of the base 102 to cover the gap formed between the second distal edges of the first distal segment 114 and the second distal segment 118. The base 102 may be disposed in front of or behind the end portions of the distal segments 114 and 118.

In one implementation, a central connection 101 (e.g., a first seam portion—central connection 101A, a second seam portion—central connection 101B, and third seam portion—central connection 101C) of the ballistic collar 100 is formed along the connection between the first arm 104, the second arm 108, and the base 102. For example, the connection between: the first proximal segment 112 and the first distal segment 114; the second proximal segment 116 and the second distal segment 118; and the base 102 may all extend along the central connection 101. More particularly, the proximal body edge of the base 102, the third proximal edges of the proximal segments 112/116, and the fourth distal edges of the distal segments 114/118 may extend along the central connection 101. The angles between: the first proximal segment 112 and the first distal segment 114; the second proximal segment 116 and the second distal segment 118; and the base 102 and one or more of the segments 112-118 changes based on a relative movement of one or more of the first proximal segment 112, the first distal segment 114, the second proximal segment 116, the second distal segment 118, and the base 102.

The first arm 104, the second arm 108, and the base 102 are disposed in an overlapping relationship providing coverage to the neck area of the wearer, and each of the first proximal segment 112, the first distal segment 114, the second proximal segment 116, the second distal segment 118, and the base 102 is independently moveable relative to one or more of each other.

In one implementation, the inner surfaces of the first arm 104 and the second arm 108 includes a proximal inner surface 136 and a distal inner surface 142, which may be disposed on the proximal segments 112/116 and the distal segments 114/118, respectively. The inner surfaces 136 and 142 may include a cover enclosing padding. The cover may be a mesh, made from an antimicrobial, moisture resistant, and/or fire resistant treated material.

The ballistic collar 100 may connect to or otherwise function in cooperation with other tactical devices, including, but not limited to, a tactical vest, a helmet, a throat apparatus, and/or the like. For example, the proximate segments 112/116 of the arms 104/108 may connect to, extend into, and/or otherwise overlap with a distal portion of a helmet. Similarly, the distal segments 114/118 of the arms 104/108 and/or the base 102 may connect to, extend into, and/or otherwise overlap with a proximal portion of a tactical vest. Further, a throat apparatus may connect to, extend into, and/or otherwise overlap with one or more of the segments 112-118. As such, a tactical system is provided without gaps in threat protection.

Additionally, the independent movement of the various features and/or various attachments among the tactical devices permits freedom of movement by the wearer without restricting or otherwise impairing the functionality of the tactical devices. The ballistic collar 100 may include one or more attachments for connecting to various tactical devices. In one implementation, the ballistic collar 100 includes one or more of a throat attachment(s) 122, a shoulder strap attachment(s) 126, a back carrier attachment(s) (e.g., attachments 130-132), one or more couplers 138, and/or the like.

In one implementation, each of the first distal segment 114 and the second distal segment 118 includes the shoulder strap attachment 126. Each of the shoulder strap attachments 126 may include a strap channel 124 formed between the outer surface of the respective distal segment 114/118 and an inner surface of the shoulder strap attachment 126. Further, each of the shoulder strap attachments 126 may include a strap connector 120, which may include, without limitation, a hook and loop fastener surface, a button connector, a snap connector, a buckle, and/or other connectors.

Each of the first proximal segment 112 and the second proximal segment 116 may include the throat attachment 122. Each of the throat attachments 122 may include a throat channel 128 formed between the outer surface of the respective proximal segment 112/116 and an inner surface of the throat attachment 122.

In one implementation, the back carrier attachments include a back connector 134, one or more tongues 130 (e.g., a set of parallel extending tongues), and/or other attachments for connecting to a back carrier of a tactical vest. The back carrier attachments 130 and 134 may extend from or otherwise be disposed on the base 102. The back connector 134 may include, without limitation, a hook and loop fastener surface, a button connector, a snap connector, a buckle, and/or other connectors. In one implementation, each of the tongues 130 includes a tongue surface 132 pivotable relative to the tongue 130 for insertion through and attachment to corresponding features of the back carrier of the tactical vest.

The one or more couplers 138 may be disposed at various locations about the first arm 104, the second arm 108, and/or the base 102 for connection with one or more tactical devices. The couplers 138 may be, without limitation, a buckle, a D-ring, an O-ring, a hook and loop fastener surface, a button connector, a snap connector, and/or other connectors.

Figure 8:
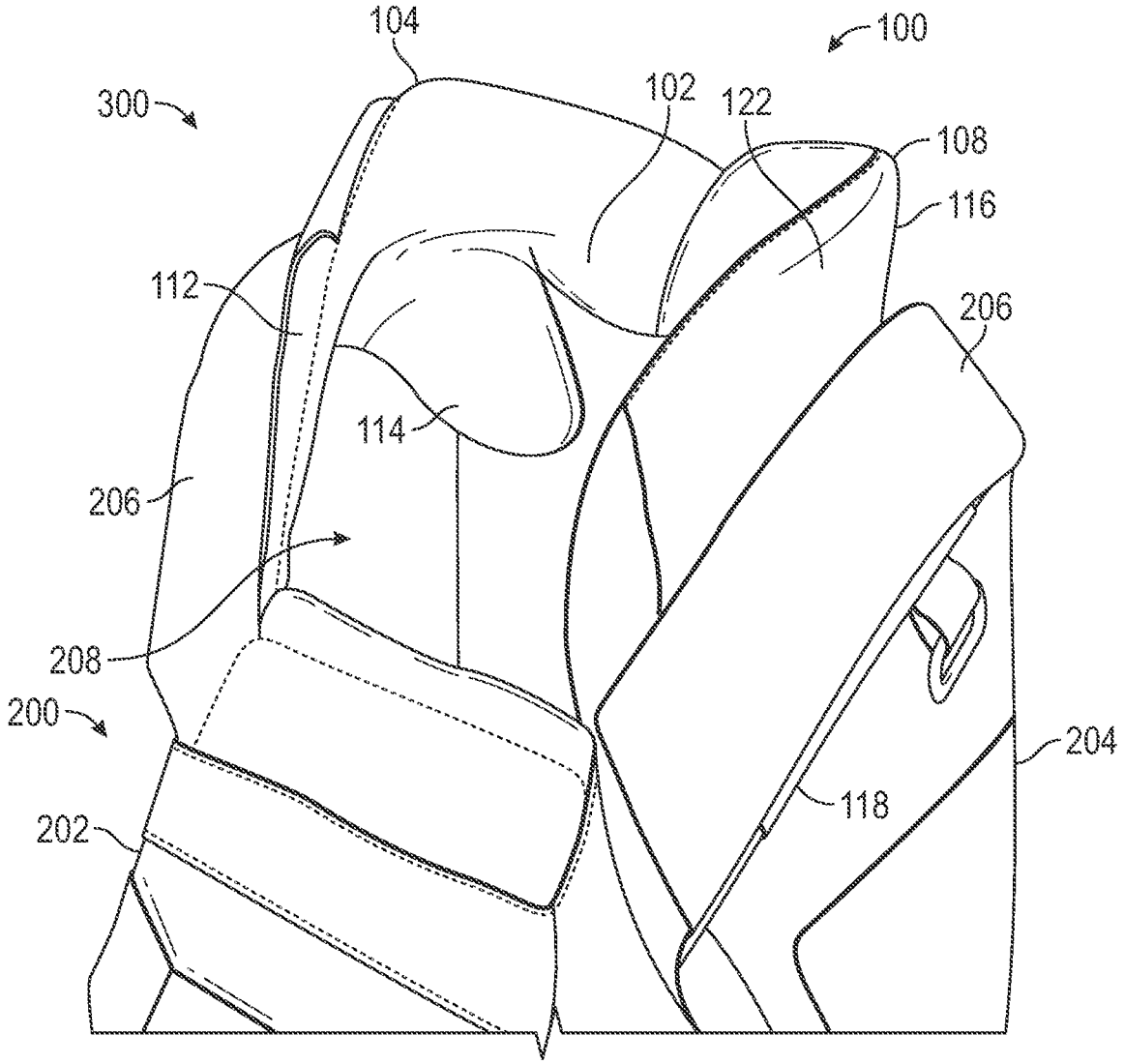
FIG. 8 is a isometric view of the ballistic collar of FIG. 1 coupled with an example tactical vest.
Figure 9:
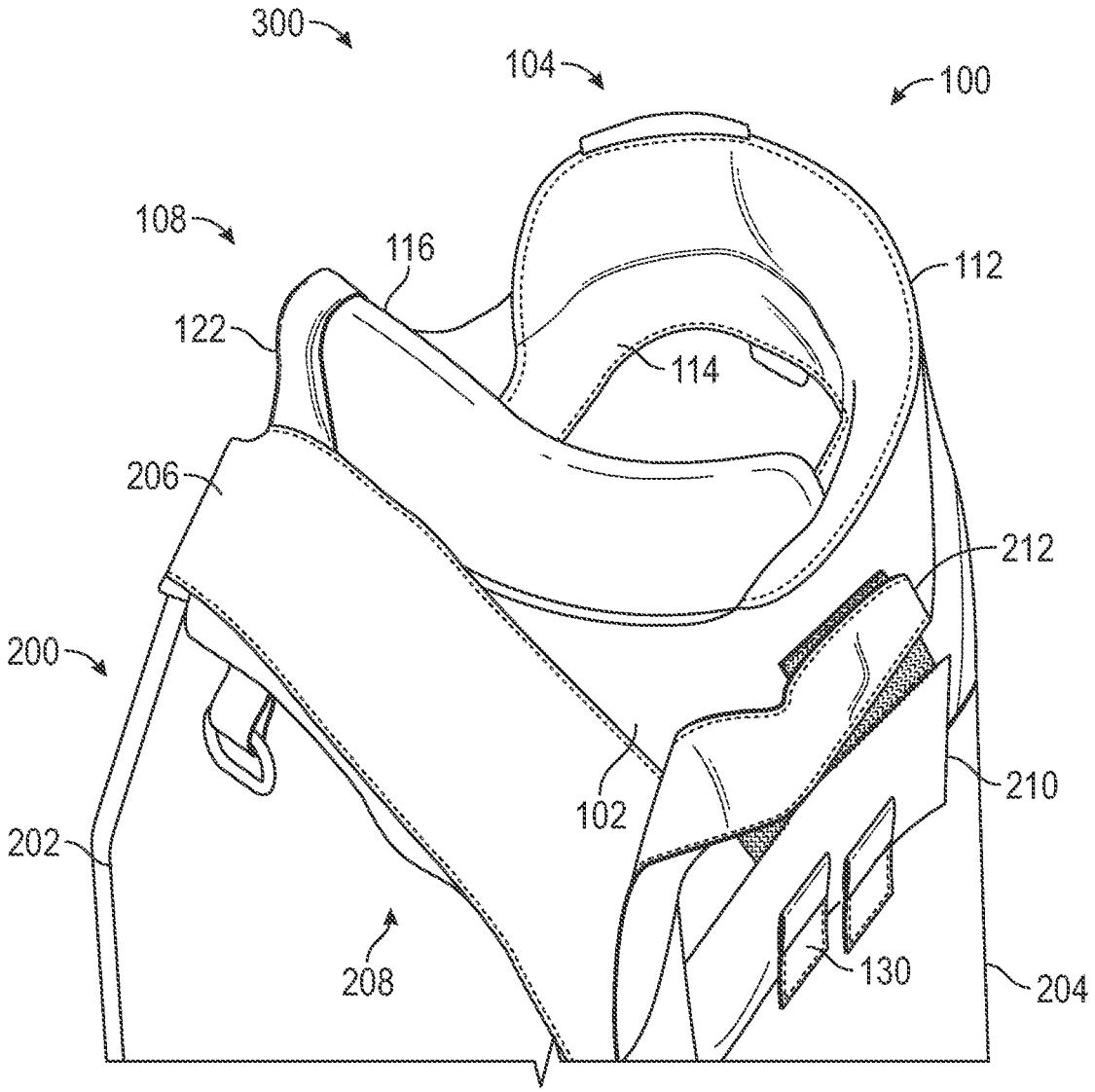
FIG. 9 is a rear isometric view of the ballistic collar of FIG. 1 coupled with the tactical vest.
Figure 10:
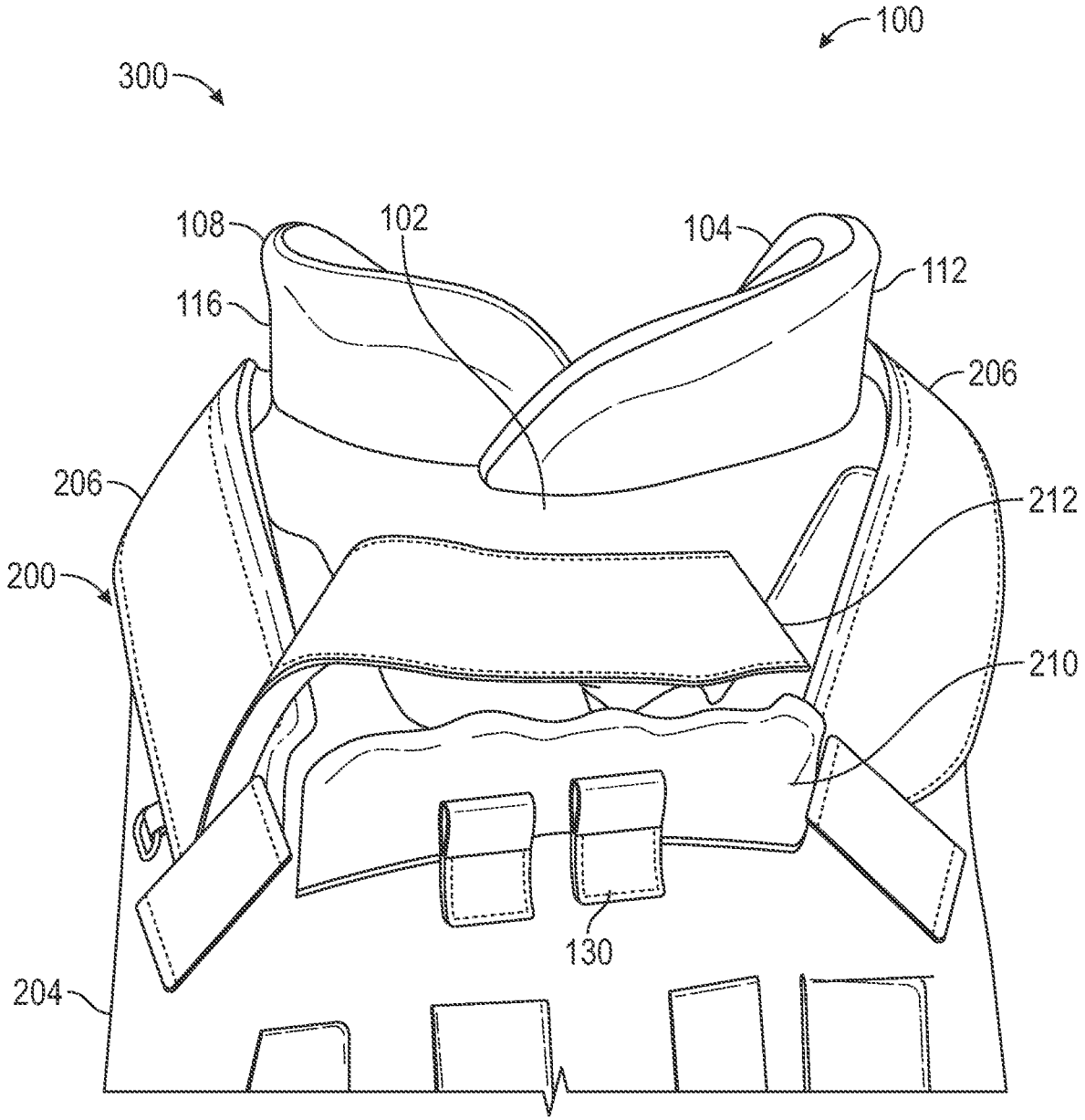
FIG. 10 is a rear view of the ballistic collar of FIG. 1 coupled with the tactical vest.
Figure 11:
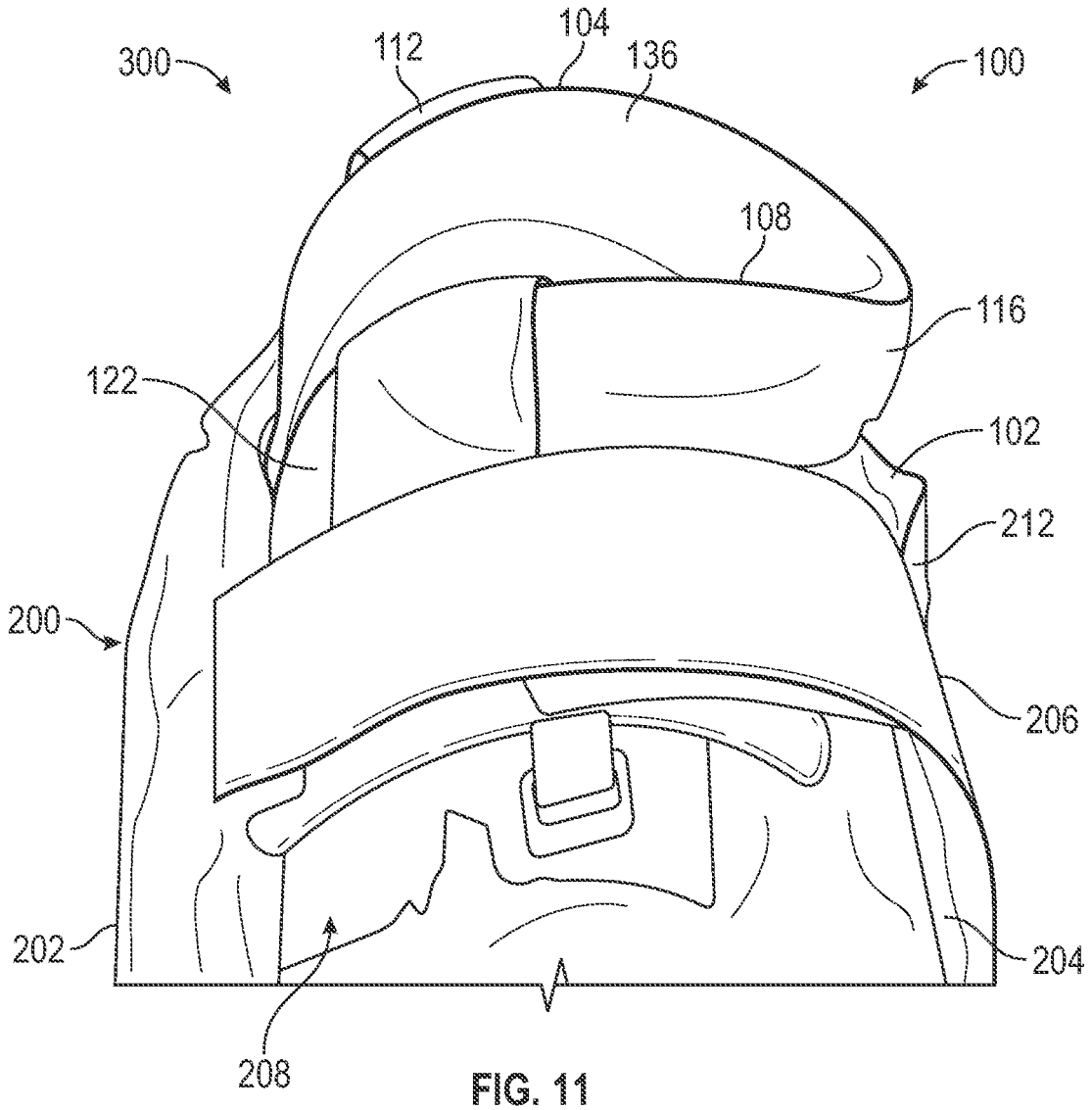
FIG. 11 is a left side view of the ballistic collar of FIG. 1 coupled with the tactical vest.
Figure 12:
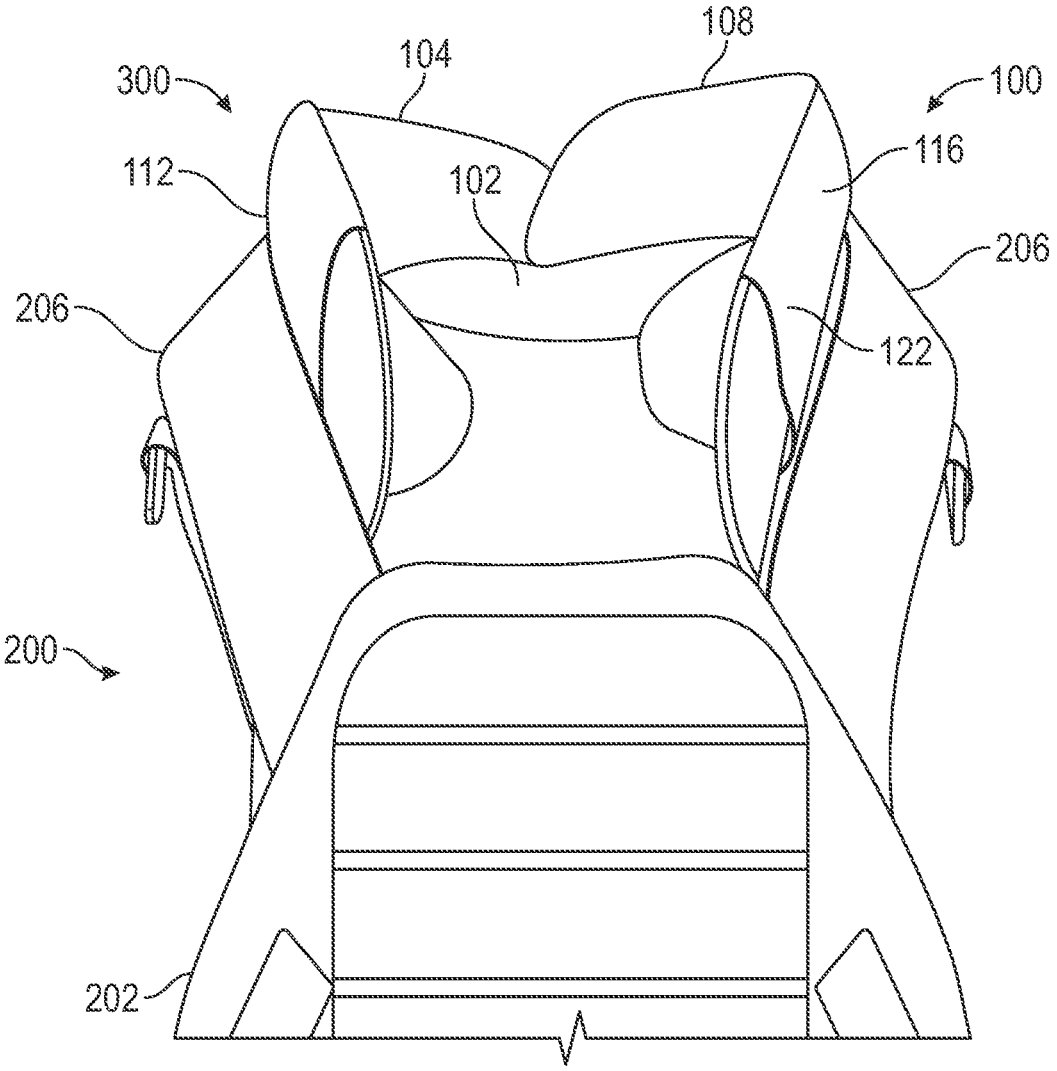
FIG. 12 is a front view of the ballistic collar of FIG. 1 coupled with the tactical vest.

For a detailed description of an example tactical system 300 including the ballistic collar 100 and an example tactical vest 200, reference is made to FIGS. 8-12. In one implementation, the tactical vest 200 includes a front carrier 202 opposite a back carrier 204 and defining a receiving space 208 therebetween. The front carrier 202 may be connected to the back carrier 204 using a set of shoulder straps 206, including a first shoulder strap and a second shoulder strap. A handle 212 may extend from the back carrier 204 and/or the shoulder straps 206. The back carrier 204 may include one or more rows of webbing 210. Modular Lightweight Load-carrying equipment (MOLLE) webbing adapted to carry mission specific equipment that may be interchanged based on the needs of the mission. The row(s) of webbing 210 and/or the handle 212 may be made from a variety of materials having superior strength and resistance to cutting and abrasion, such as nylon.

The ballistic collar 100 may be connected to and overlap with the tactical vest 200 in a variety of manners that prevent gaps in threat coverage for the wearer while permitting freedom of movement. Further, the tactical vest 200 may include a cutaway system, which when released permit the tactical vest 200 to be easily and quickly removed. The ballistic collar 100 is connected to the tactical vest 200 in a manner that does not impair the functionality or otherwise impact or interfere with the cutaway system.

In one implementation, each of the shoulder straps 206 extends from the back carrier 204 through the strap channel 124 of the shoulder strap attachment 126, is looped through a connector of the front carrier 202, and is connected to the strap connector 120 of the shoulder strap attachment 126. In this manner, the shoulder straps 206 extend along the distal segments 114 and 118.

The back carrier attachments may connect the ballistic collar 100 to the back carrier 204 in a variety of manners. In one implementation, the handle 212 connects to the back connector 134. For example, the handle 212 and the back connector 134 may include paired loop and hook fastener surfaces. The one or more tongues 130 may connect with the one or more rows of webbing 210. In one implementation, the tongue surface 132 is insertable through a channel defined by the webbing 210 and secured by pivoting the tongue surface 132 until it is generally parallel relative to a surface of the webbing 210.

As described herein, the first arm 104 and the second arm 108 may include one or more throat attachments 122 for engaging a throat apparatus adapted to protect the throat area of the wearer. In one implementation, each of the throat attachments 122 includes the throat channel 128 formed between the outer surface of the respective proximal segment 112/116 and the inner surface of the throat attachment 122, as shown in FIGS. 1-12. Each of the throat channels 128 is configured to receive a respective portion of the throat apparatus.

Figure 13:
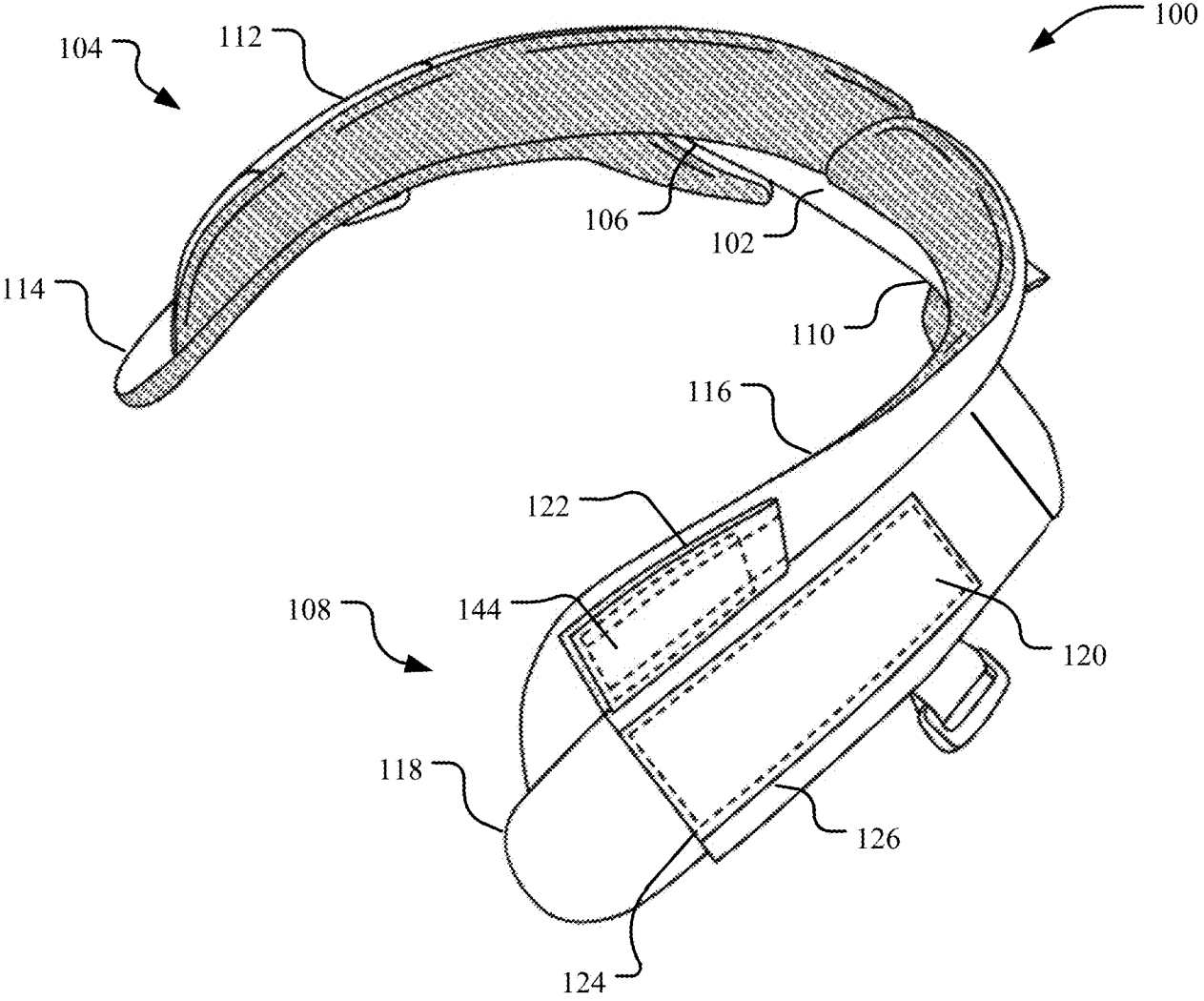
FIG. 13 is a front isometric view of another example ballistic collar.
Figure 14:
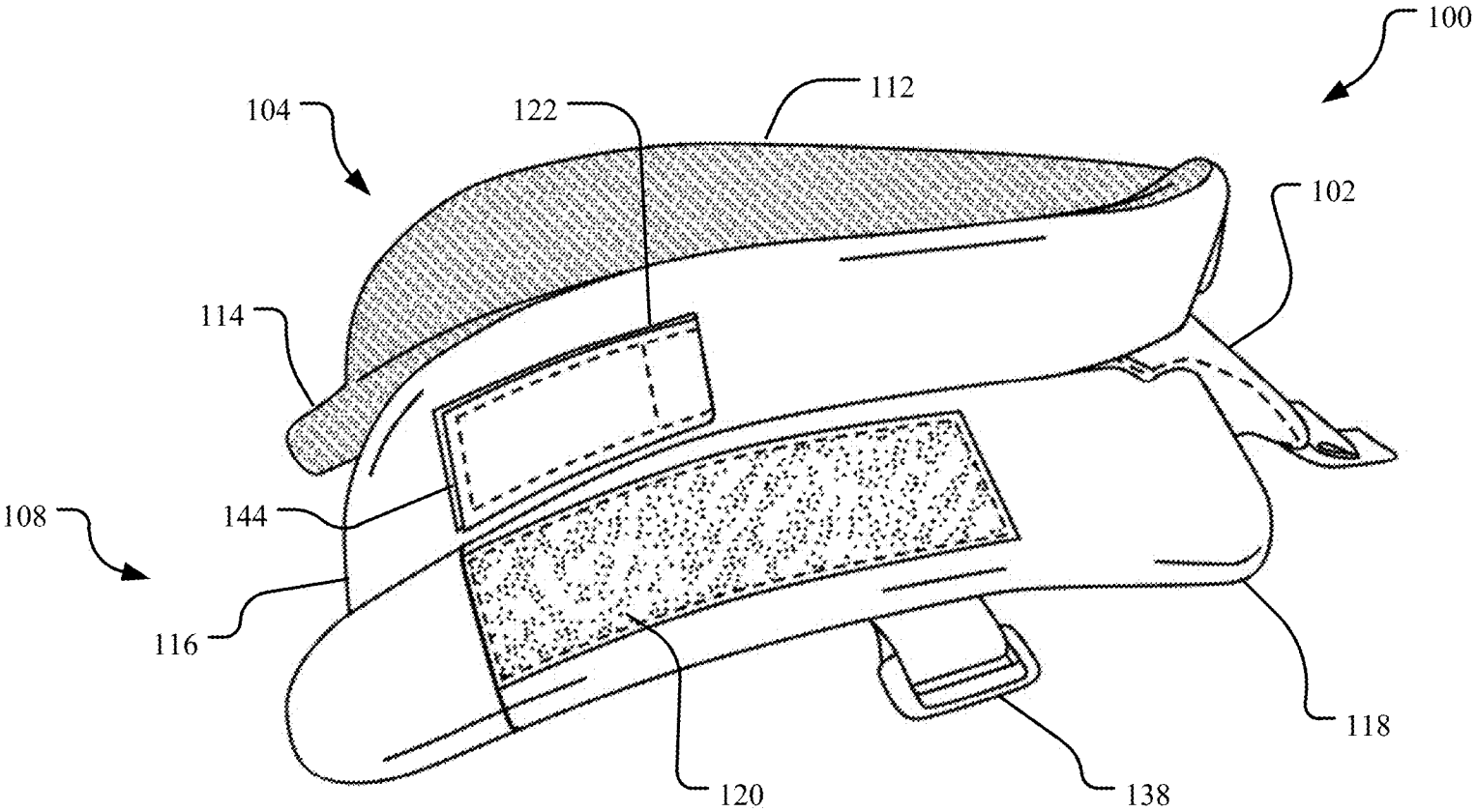
FIG. 14 is a left side view of the ballistic collar of FIG. 13 with a throat attachment in a closed configuration.
Figure 15:
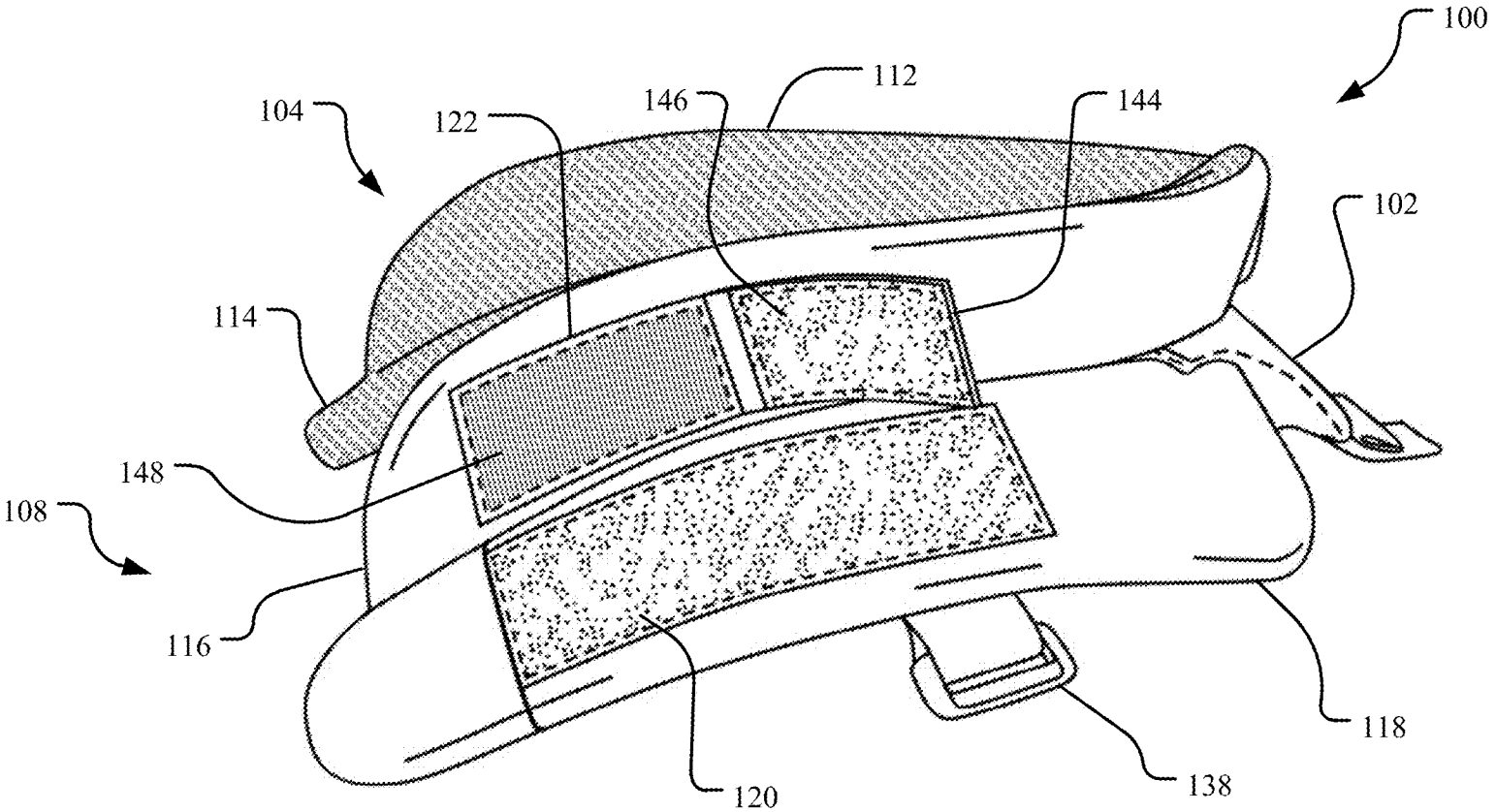
FIG. 15 is a left side view of the ballistic collar of FIG. 13 with the throat attachment in an open configuration.
Figure 16:
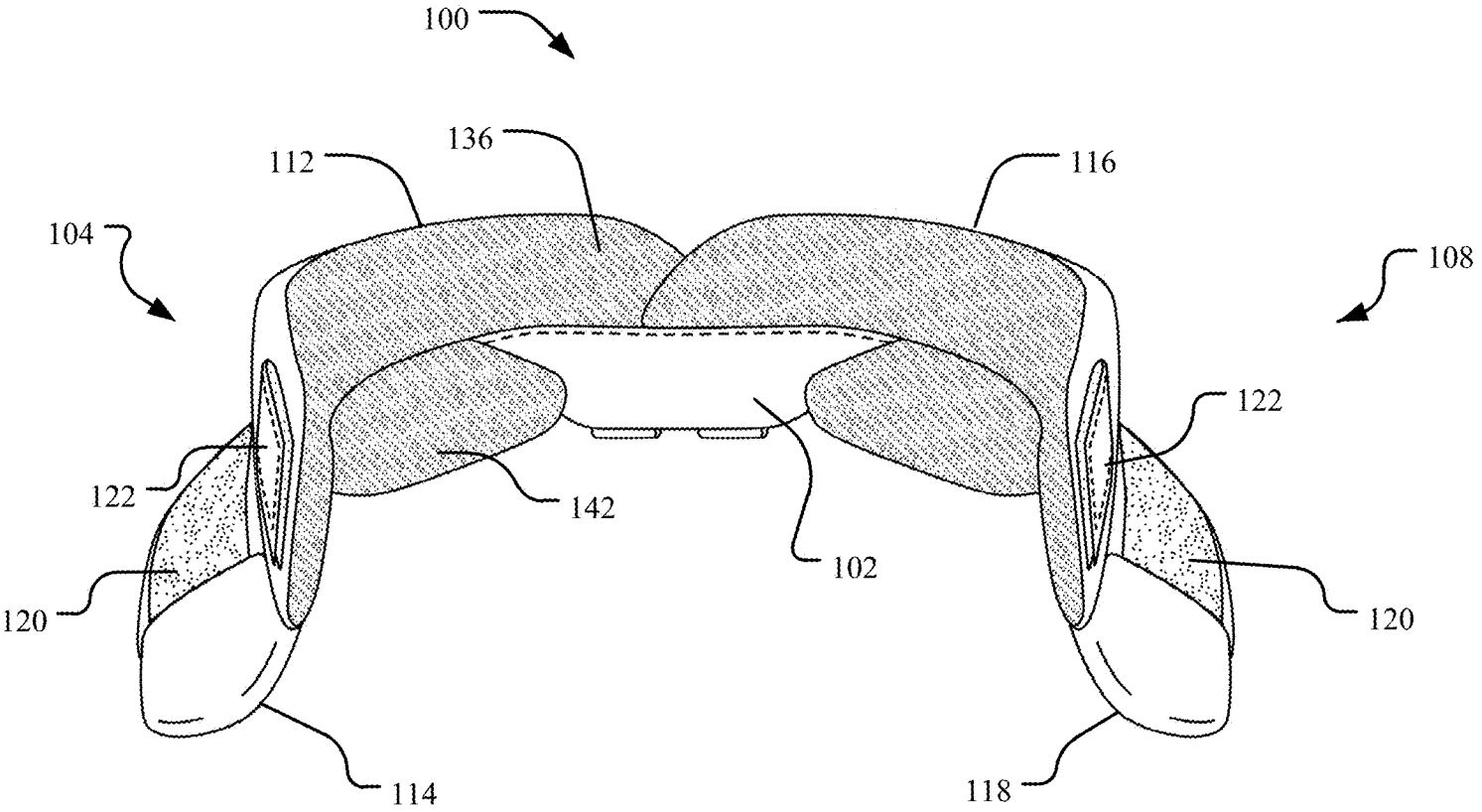
FIG. 16 is a front elevation view of the ballistic collar of FIG. 13.
Figure 17:
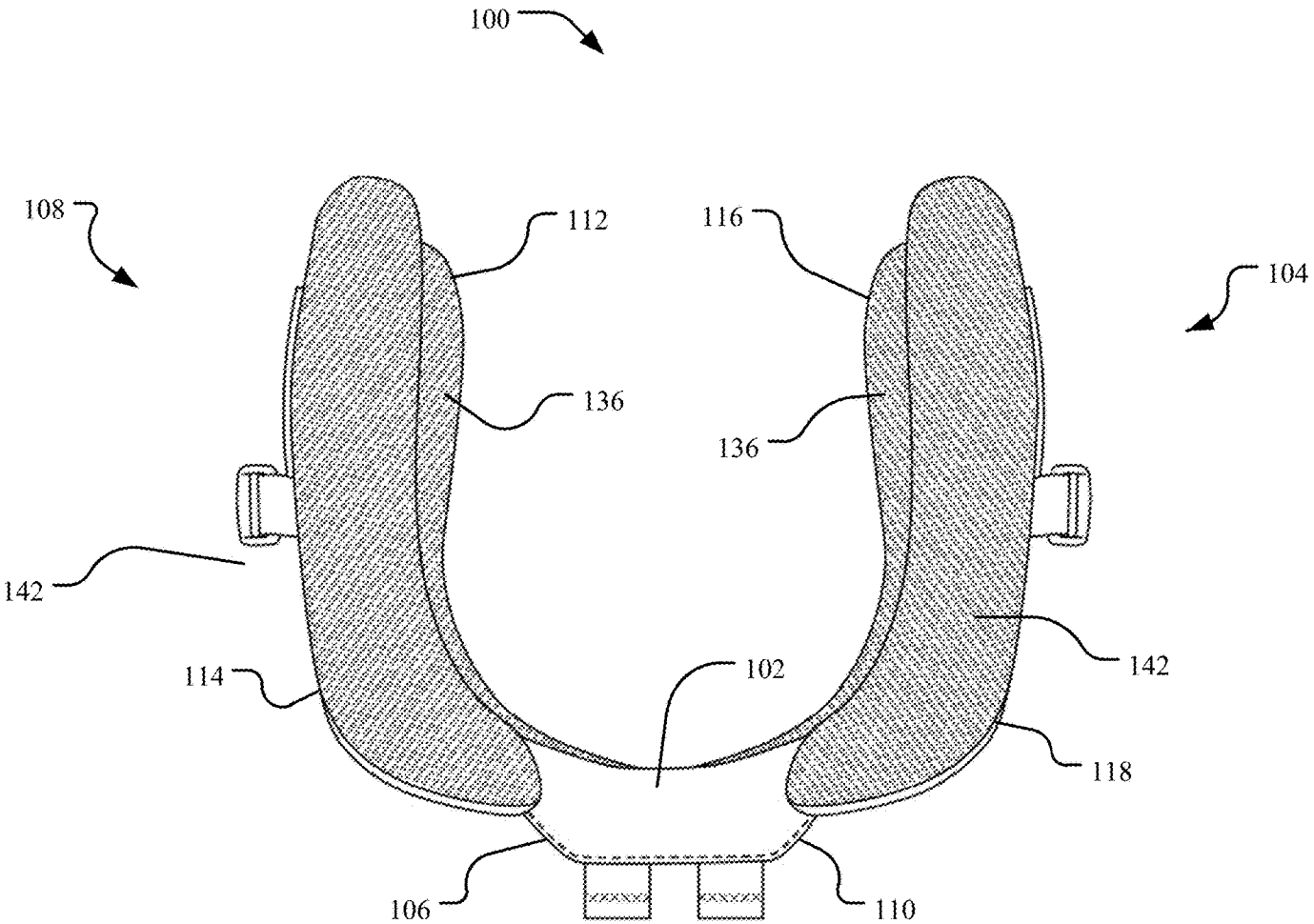
FIG. 17 is a bottom planar view of the ballistic collar of FIG. 13.
Figure 18:
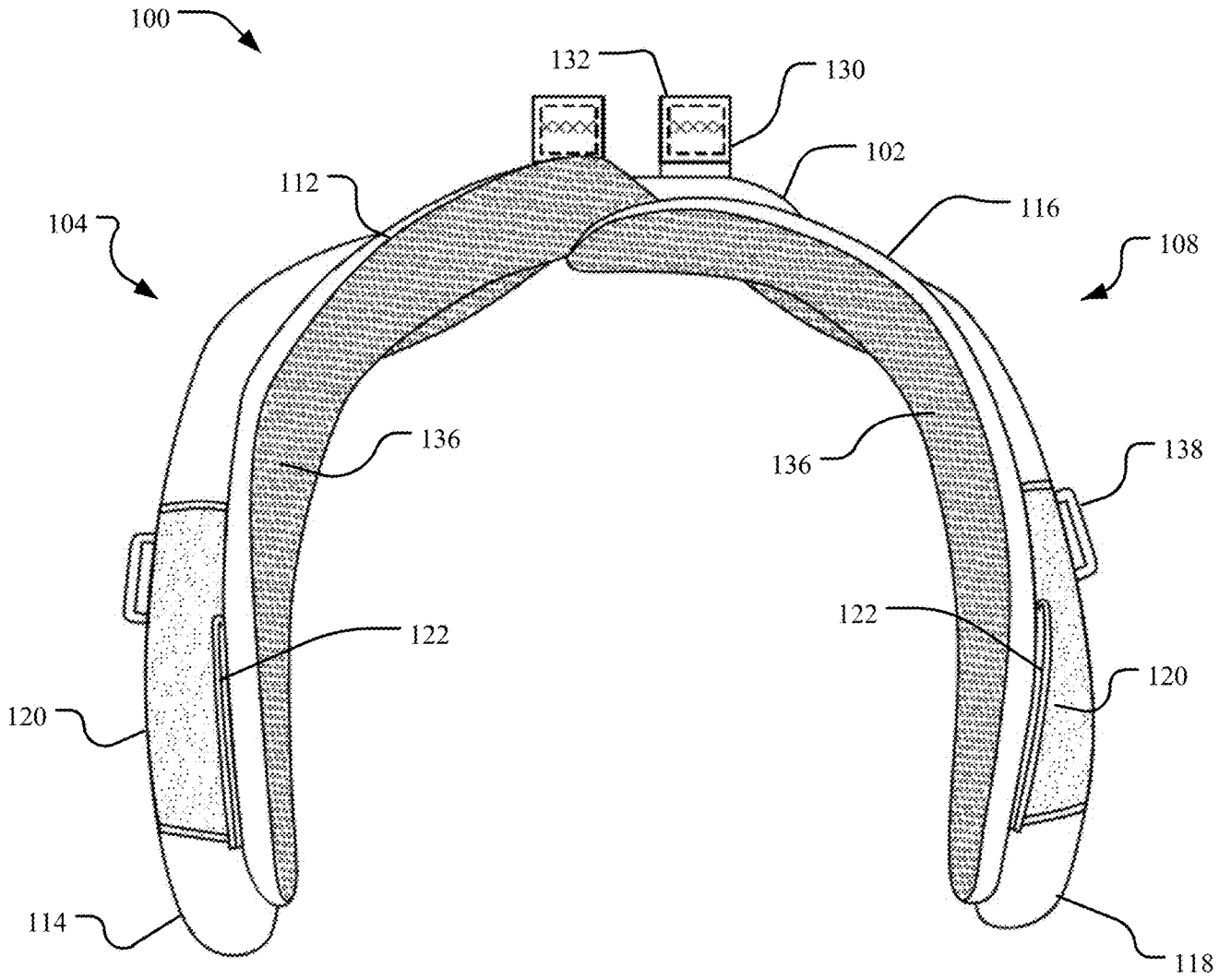
FIG. 18 is a top planar view of the ballistic collar of FIG. 13.
Figure 19:
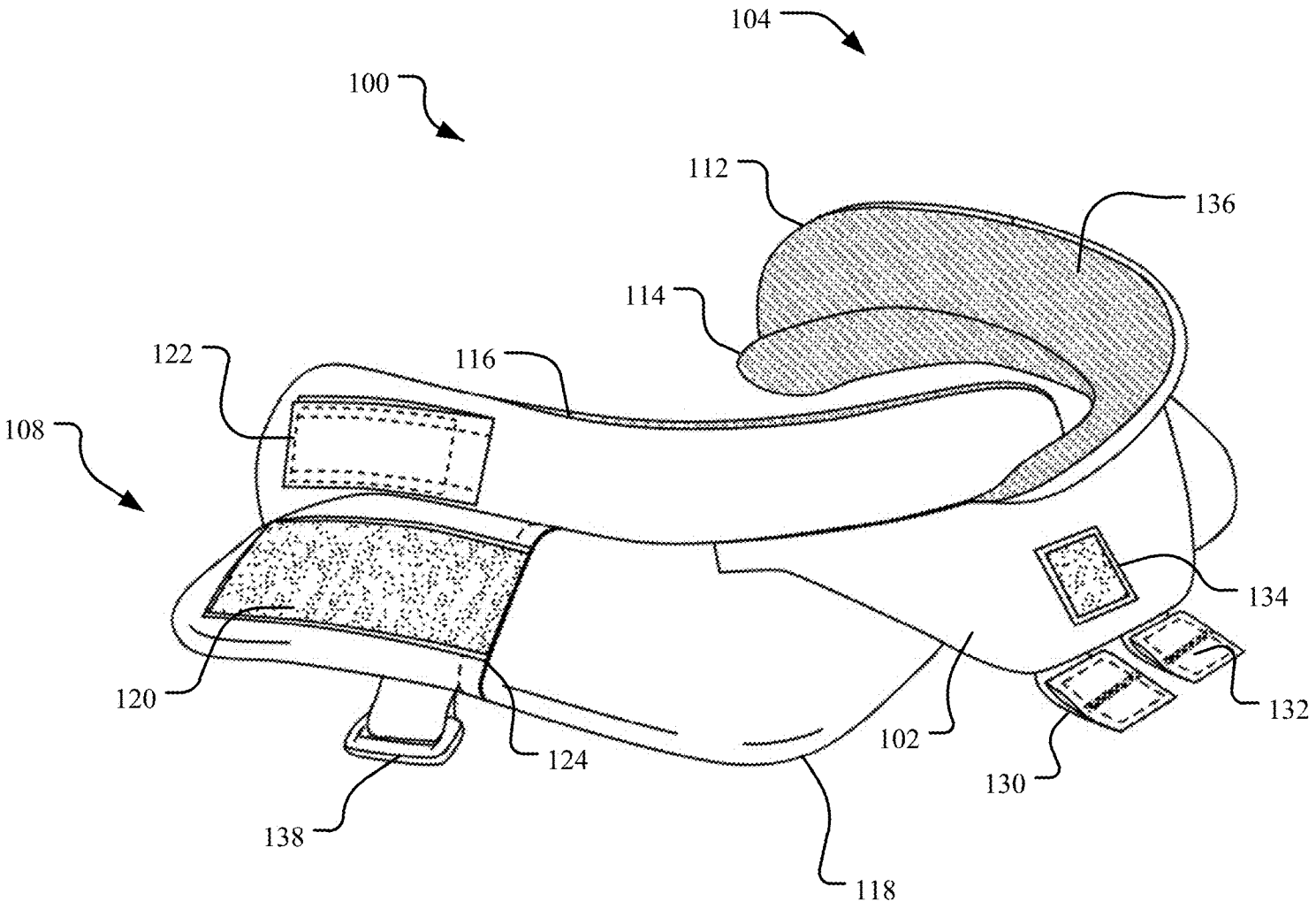
FIG. 19 is a rear isometric view of the ballistic collar of FIG. 13.
Figure 20:
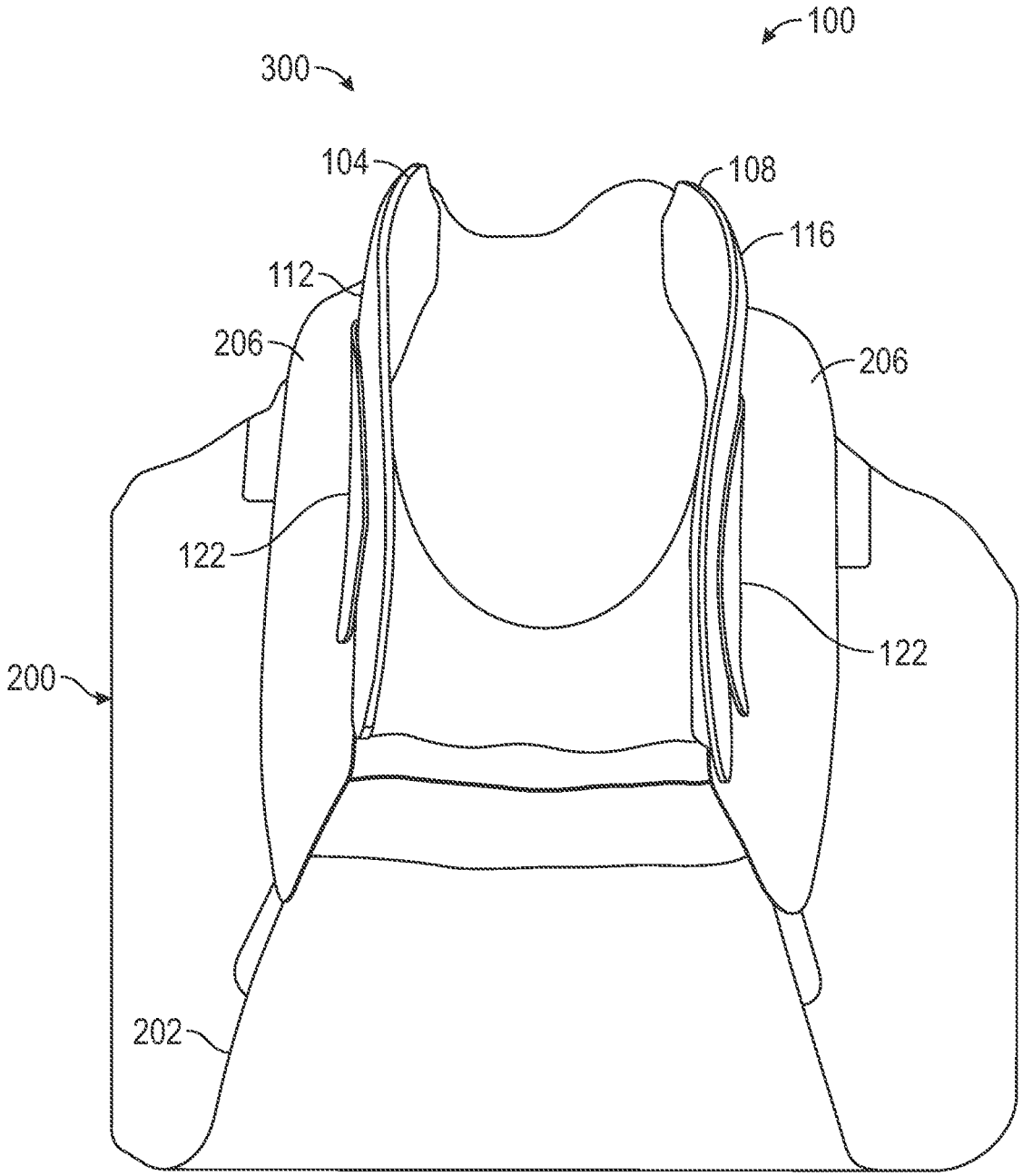
FIG. 20 is a front view of the ballistic collar of FIG. 13 coupled with the tactical vest.
Figure 21:
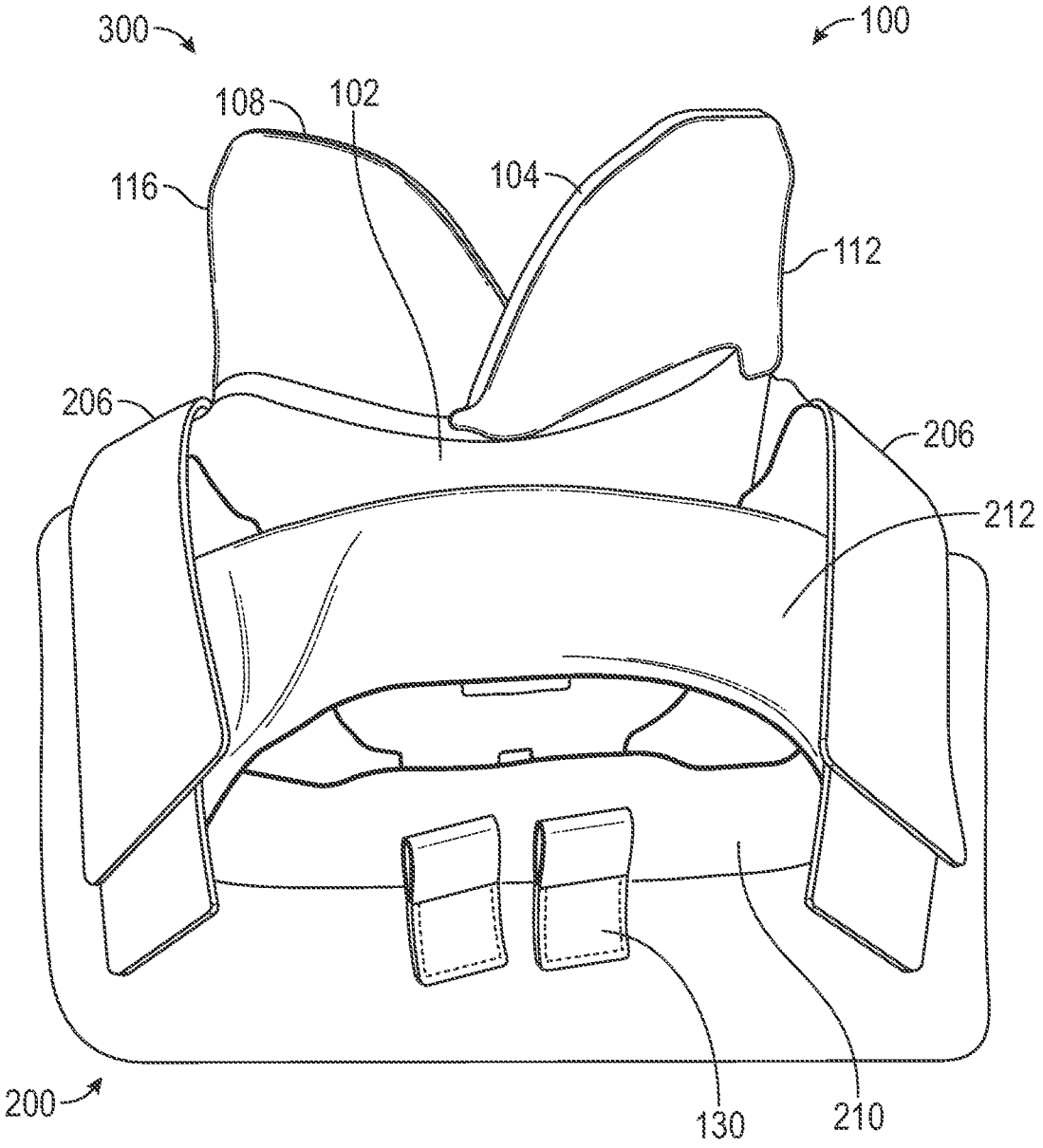
FIG. 21 is a rear view of the ballistic collar of FIG. 13 coupled with the tactical vest.
Figure 22:
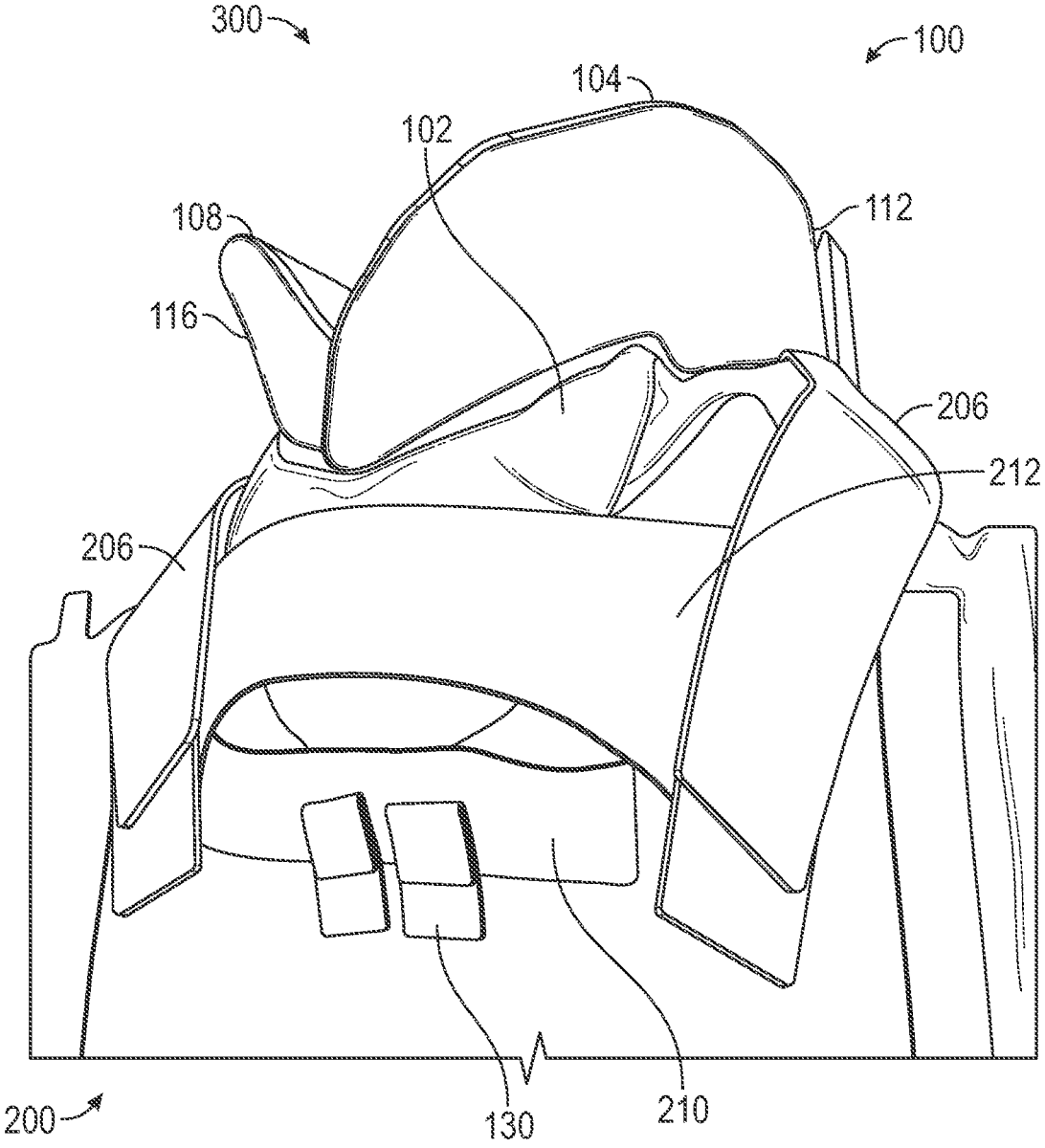
FIG. 22 is a rear perspective view of the ballistic collar of FIG. 13 coupled with the tactical vest.
Figure 23:
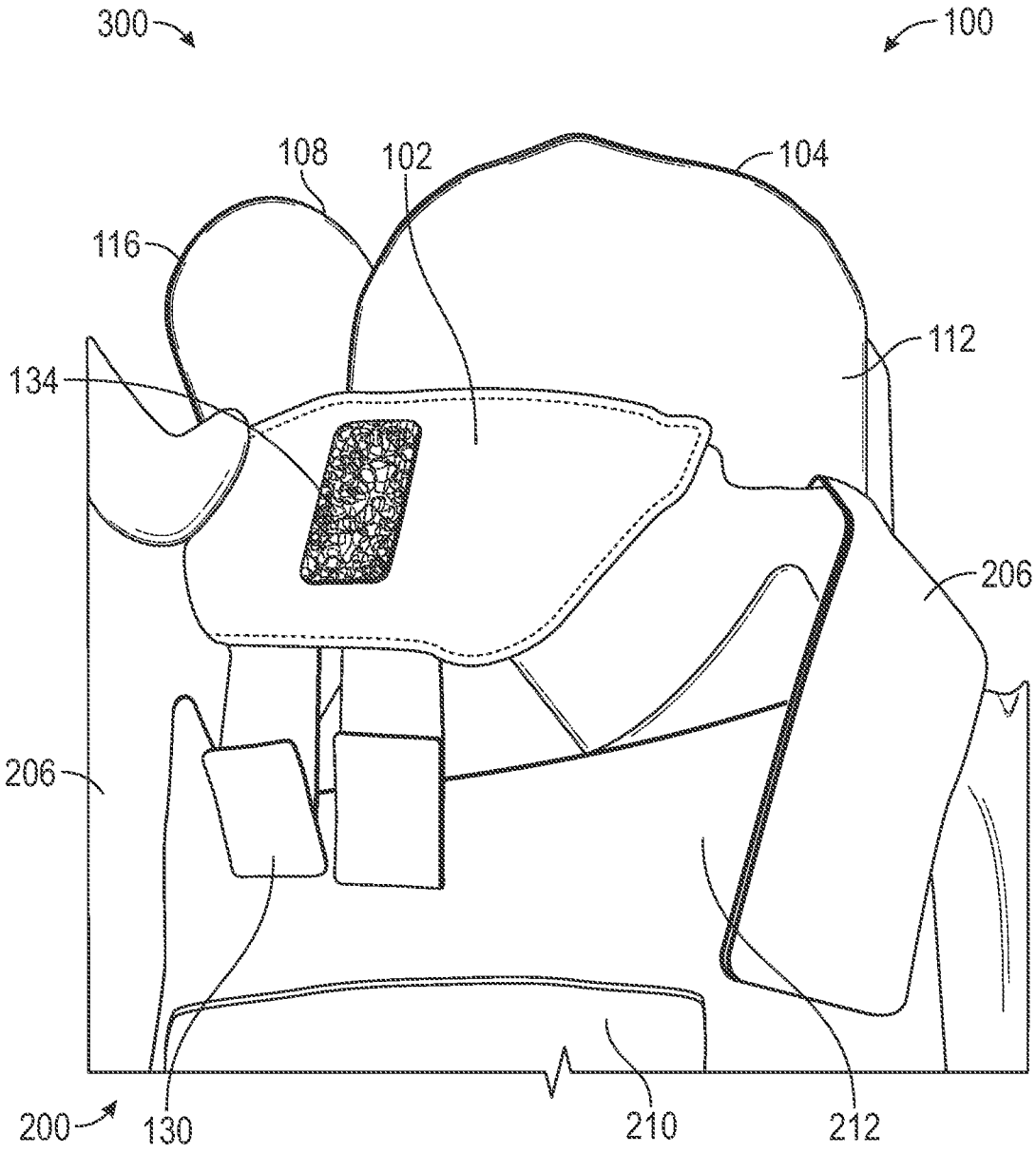
FIG. 23 is a rear view of the ballistic collar of FIG. 13 partially decoupled from the tactical vest.

As can be understood from FIGS. 13-23, in another implementation, the throat attachment 122 includes a flap 144 and one or more connectors, such as a first fastening surface 146 and a second fastening surface 148. Other connectors including, without limitation, a buckle, a D-ring, an O-ring, a button connector, a snap connector, and/or the like are contemplated. In one implementation, the first collar fastening surface 146 is disposed on an inner side of the flap 144, and the second collar fastening surface 148 is disposed relative to the first collar fastening surface 146, for example on the outer surface of the corresponding proximal segment 112/116 or another surface of the throat attachment 122. The fastening surfaces 146-148 may include paired hook and loop fasteners adapted to engage each other and similar fastening surfaces on a throat apparatus to close the flap 144.

Figure 24:
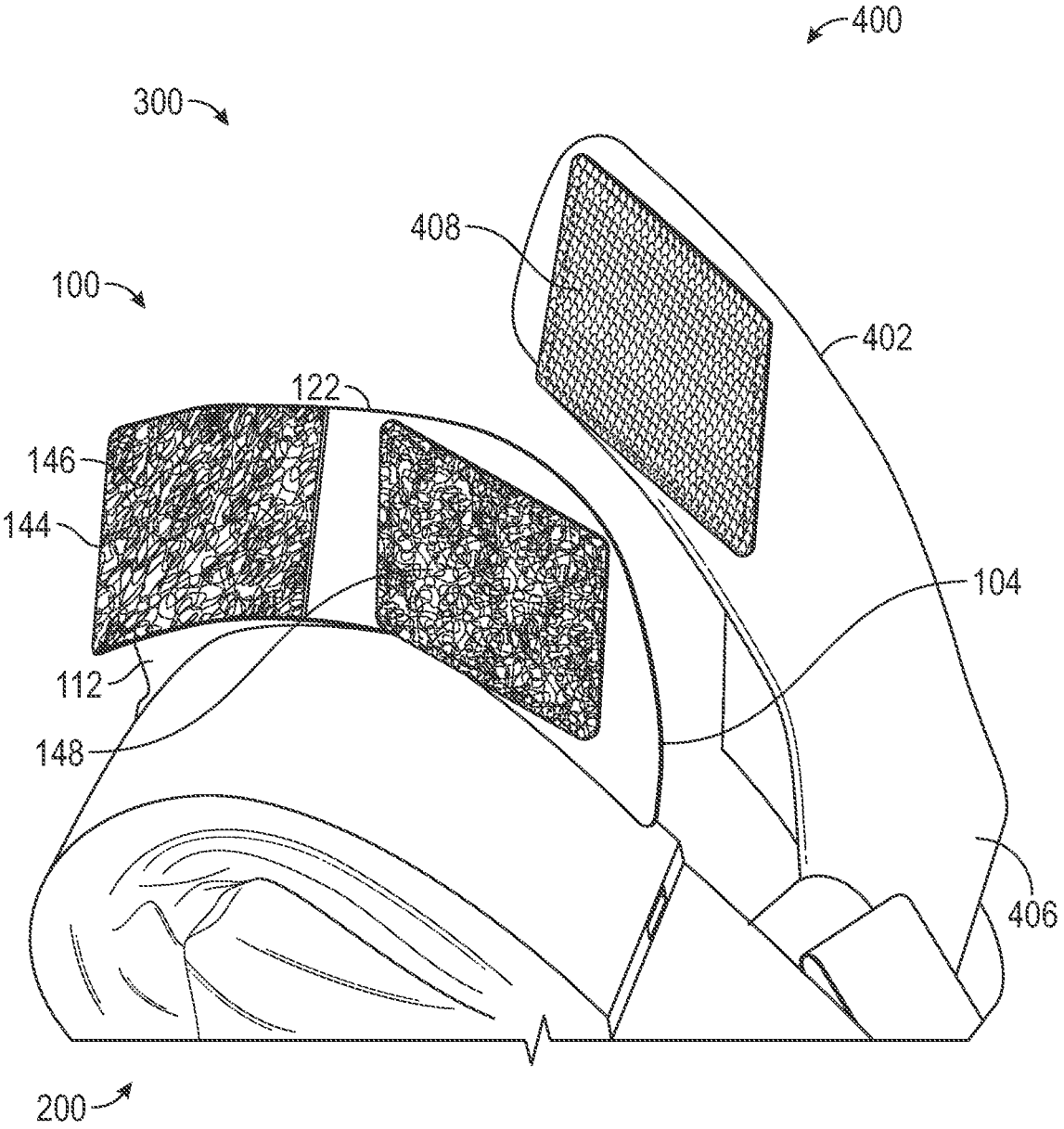
FIG. 24 shows an example throat apparatus decoupled from the ballistic collar of FIG. 13.
Figure 25:
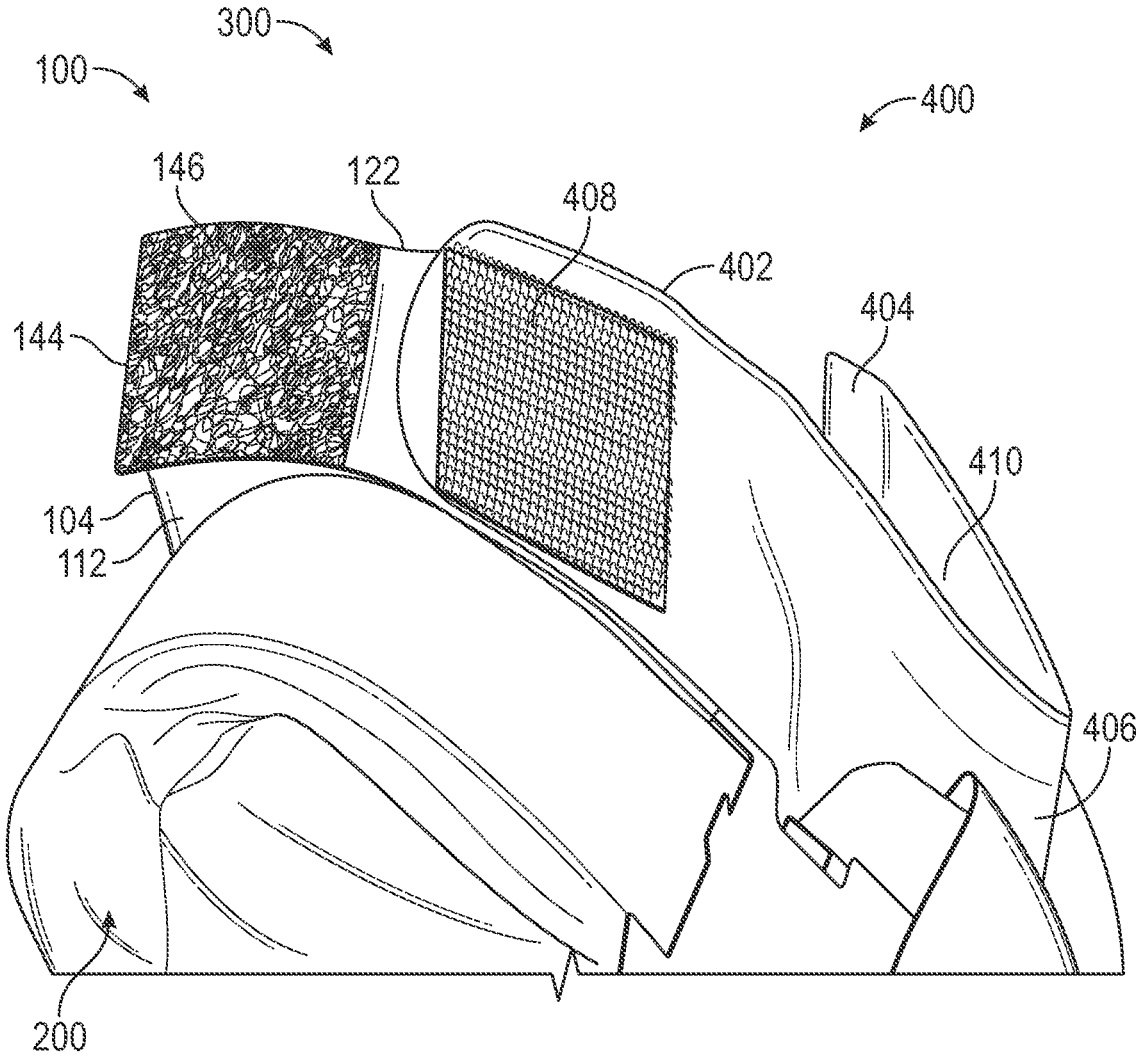
FIG. 25 illustrates the throat apparatus coupled to the ballistic collar of FIG. 13 with the throat attachment in the open configuration.
Figure 26:
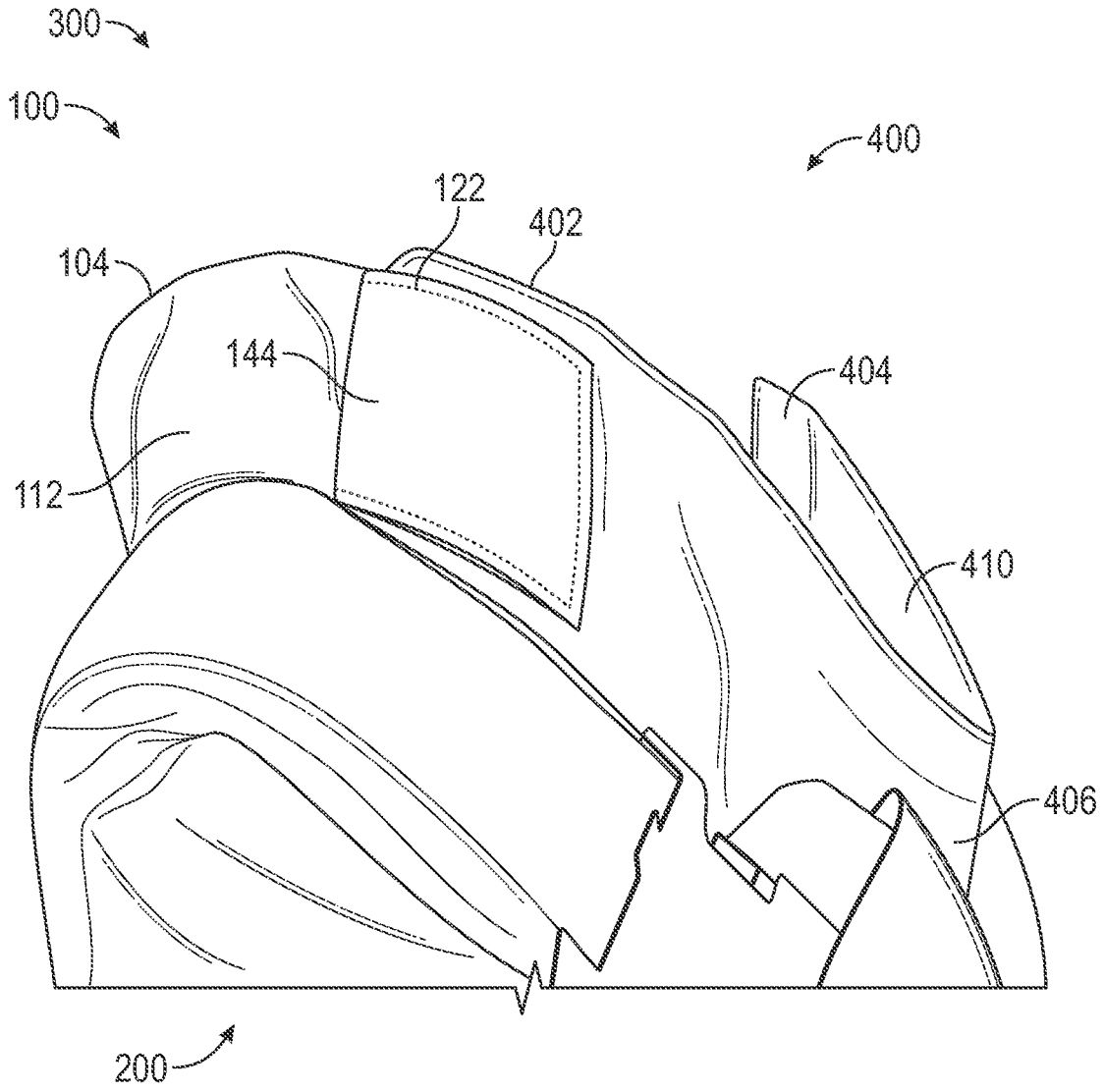
FIG. 26 shows the throat apparatus coupled to the ballistic collar of FIG. 13 with the throat attachment in the closed configuration.
Figure 27:
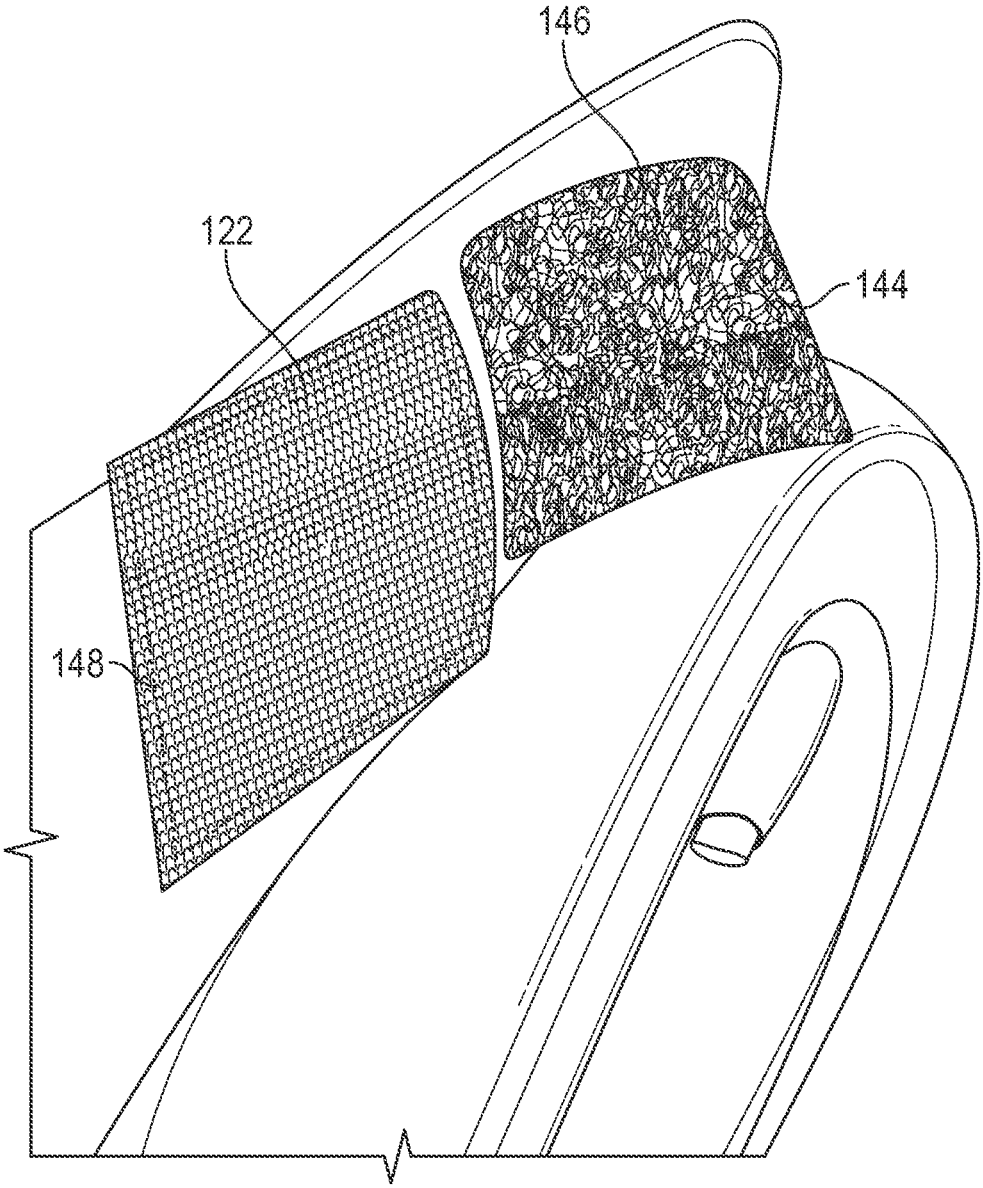
FIG. 27 is a detailed view of the throat apparatus coupled to the ballistic collar of FIG. 13 with the throat attachment in the open configuration.
Figure 28:
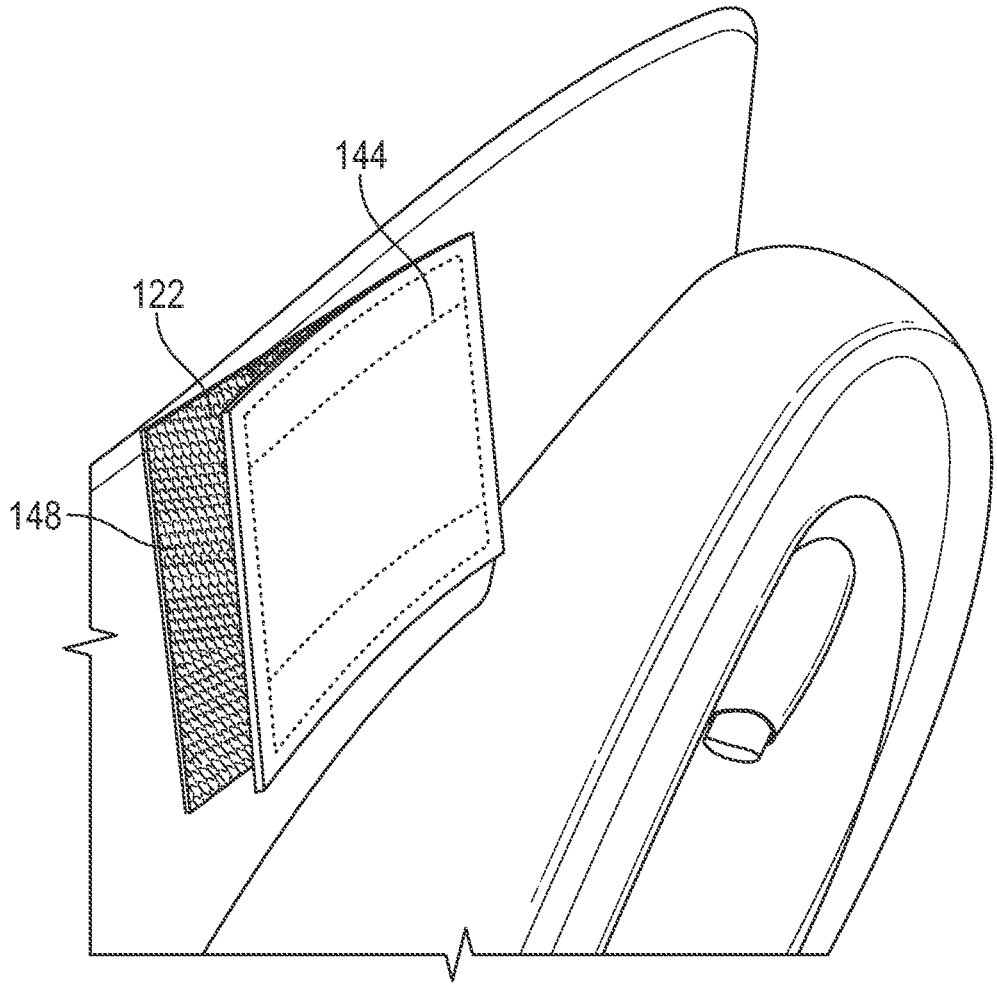
FIG. 28 is a detailed view of the throat apparatus coupled to the ballistic collar of FIG. 13 with the throat attachment in the closed configuration.

As shown in FIGS. 24-28, in one implementation, a throat apparatus 400 includes a body having a first throat arm 402 and a second throat arm 404. The body extends along a contour from the first throat arm 402 to the second throat arm 404. In one implementation, the throat apparatus includes one or more connectors, such as one or more throat fastening surfaces 408 disposed on an inner surface 410 and/or an outer surface 406 of the body of the throat apparatus 400. Other connectors including, without limitation, a buckle, a D-ring, an O-ring, a button connector, a snap connector, and/or the like are contemplated.

In one implementation, the throat fastening surfaces 408 include at least one first throat fastening surface disposed on the first throat arm 402 and at least one second throat fastening surface disposed on the second arm 404. Each of the throat fastening surfaces 408 is configured to engage a corresponding collar fastening surface of the ballistic collar 100. In one implementation, a first inner throat fastening surface is disposed on the inner surface 410 of the first throat arm 402, and a second inner throat fastening surface is disposed on the inner surface 410 of the second throat arm 404. The inner throat fastening surfaces are configured to engage corresponding second collar fastening surfaces 148. A first outer throat fastening surface is disposed on the outer surface 406 of the first throat arm 402, and a second outer throat fastening surface is disposed on the outer surface 406 of the second throat arm 404. The outer throat fastening surfaces are configured to engage corresponding first collar fastening surfaces 146.

As such, the throat arms 402 and 404 are positioned relative to the throat attachments 122, and the inner throat fastening surfaces are engaged to the second collar fastening surfaces 148. The flap 144 is then moved from an open position to a closed position where the first collar fastening surfaces 146 engage the outer throat fastening surfaces, thereby securing the throat apparatus 400 to the ballistic collar 100. The body of the throat apparatus 400 extends into, connects to, or otherwise overlaps with the tactical vest 200 to provide coverage for the throat area of the wearer without gaps in threat prevention.

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular examples. Functionality may be separated or combined in blocks differently in various implementations of the disclosure or described with different terminology. These and other variations, modifications, additions, and improvements may fall within the scope of the disclosure as defined in the claims that follow.

What is claimed is:

1. A ballistic system, comprising:

a ballistic collar comprising:

a base having a body with a first side portion and a second side portion;

a first arm extending along a first longitudinal contour towards the first side portion, the first arm comprising a first proximal segment coupled to a first distal segment along a seam, defining a central connection, and a second arm extending along a second longitudinal contour towards the second side portion, the second arm comprising a second proximal segment coupled to a second distal segment along the seam defining the central connection, each of the first arm, the second arm, and the base being defined separately from each other and independently movable relative to each other along the central connection, wherein the first proximal segment and the second proximal segment overlap and extend above the base along the central connection, wherein the first distal segment and the second distal segment extend below the base along the central connection, and wherein the ballistic collar is configured to permit freedom of movement by a wearer; and a tactical vest including a front carrier and a back carrier, the ballistic collar connected to and overlapping the tactical vest to prevent gaps in threat coverage for the wearer, the tactical vest and the ballistic collar defining a receiving space therebetween and configured to create a gap between the wearer and the ballistic collar.

2. The ballistic system of claim 1, wherein the first proximal segment is defined separately from and independently movable relative to the first distal segment and the second proximal segment is defined separately from and independently movable relative to the second distal segment.

3. The ballistic system of claim 1, wherein the first distal segment is spaced from the second distal segment forming a gap.

4. The ballistic system of claim 3, wherein the base covers the gap.

5. The ballistic system of claim 1, wherein the first proximal segment and the second proximal segment are configured to overlap with a helmet.

6. The ballistic system of claim 1, wherein at least one of the base, the first distal segment, or the second distal segment are configured to overlap with the tactical vest.

7. The ballistic system of claim 6, wherein the first distal segment and the second distal segment each includes a shoulder strap attachment configured to connect with a shoulder strap of the tactical vest.

8. The ballistic system of claim 6, wherein the base includes one or more back carrier attachments configured to connect with the back carrier of the tactical vest.

9. The ballistic system of claim 1, wherein at least one of the first proximal segment, the second proximal segment, the first distal segment, or the second distal segment is configured to overlap with a throat apparatus.

10. The ballistic system of claim 9, wherein the first proximal segment and the second proximal segment each include a throat attachment configured to connect with the throat apparatus.

11. The ballistic system of claim 10, wherein each of the throat attachments includes at least one of a channel or a flap configured to connect with a throat arm of the throat apparatus.

* * * * *